United States Patent [19]

Klemarczyk

[11] Patent Number: 4,498,996

[45] Date of Patent: Feb. 12, 1985

[54] USE IN AUGMENTING OR ENHANCING AROMA OF PERFUMED ARTICLE WITH ACYLOXY ALKANOLS AND ESTERS THEREOF

[75] Inventor: Philip T. Klemarczyk, Newington, Conn.

[73] Assignee: International Flavors & Fragrances Inc., New York, N.Y.

[21] Appl. No.: 541,266

[22] Filed: Oct. 12, 1983

Related U.S. Application Data

[62] Division of Ser. No. 396,487, Jul. 8, 1982, abandoned.

[51] Int. Cl.[3] ..... C11D 3/50; D06M 13/20

[52] U.S. Cl. ..... 252/8.6; 252/8.8; 252/132; 252/174.11; 252/522 R

[58] Field of Search ..... 252/8.6, 8.8, 174.11, 252/132, 522 R

[56] References Cited

U.S. PATENT DOCUMENTS 3,709,929 1/1973 Exner et al. ..... 252/522 R
4,017,537 4/1977 McCollum et al. ..... 560/238
4,368,145 1/1983 Licciardello et al. ..... 252/522 R

FOREIGN PATENT DOCUMENTS 136249 10/1980 Japan .

*Primary Examiner*—Prince E. Willis

[57] ABSTRACT

Described are oxyneopentyl alkanoate derivatives defined according to the structure:

wherein $R_1$ represents hydrogen or acetyl and $R_2$ represents $C_1$–$C_3$ lower alkyl; a novel process for preparing same according to the reactions:

and and organoleptic uses thereof for augmenting or enhancing the aroma or taste of perfume compositions, perfumed articles (e.g., solid or liquid anionic, cationic, nonionic or zwitterionic detergents, fabric softener compositions, fabric softener articles, perfumed polymers, cosmetic compositions and hair preparations), colognes, foodstuffs, chewing gums, medicinal products, chewing tobaccos, toothpastes, smoking tobaccos and smoking tobacco articles.

3 Claims, 9 Drawing Figures

GLC PROFILE FOR EXAMPLE II(A).
CRUDE

GLC PROFILE FOR EXAMPLE I.
CRUDE

NMR SPECTRUM FOR EXAMPLE I.

IR SPECTRUM FOR EXAMPLE I.

GLC PROFILE FOR EXAMPLE II (B).

CRUDE

NMR SPECTRUM FOR EXAMPLE II (B).

IR SPECTRUM FOR EXAMPLE II (B)

FIG. 8
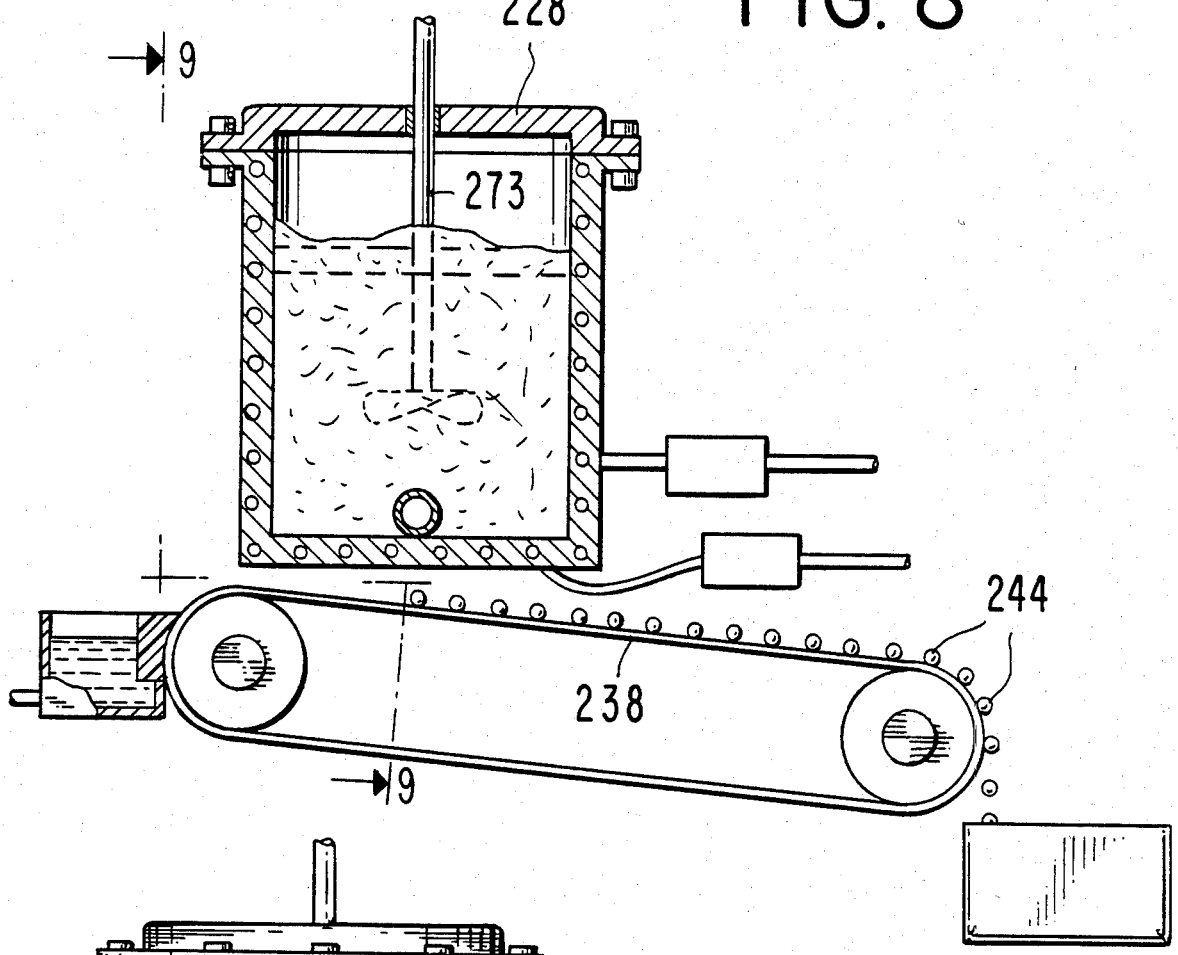
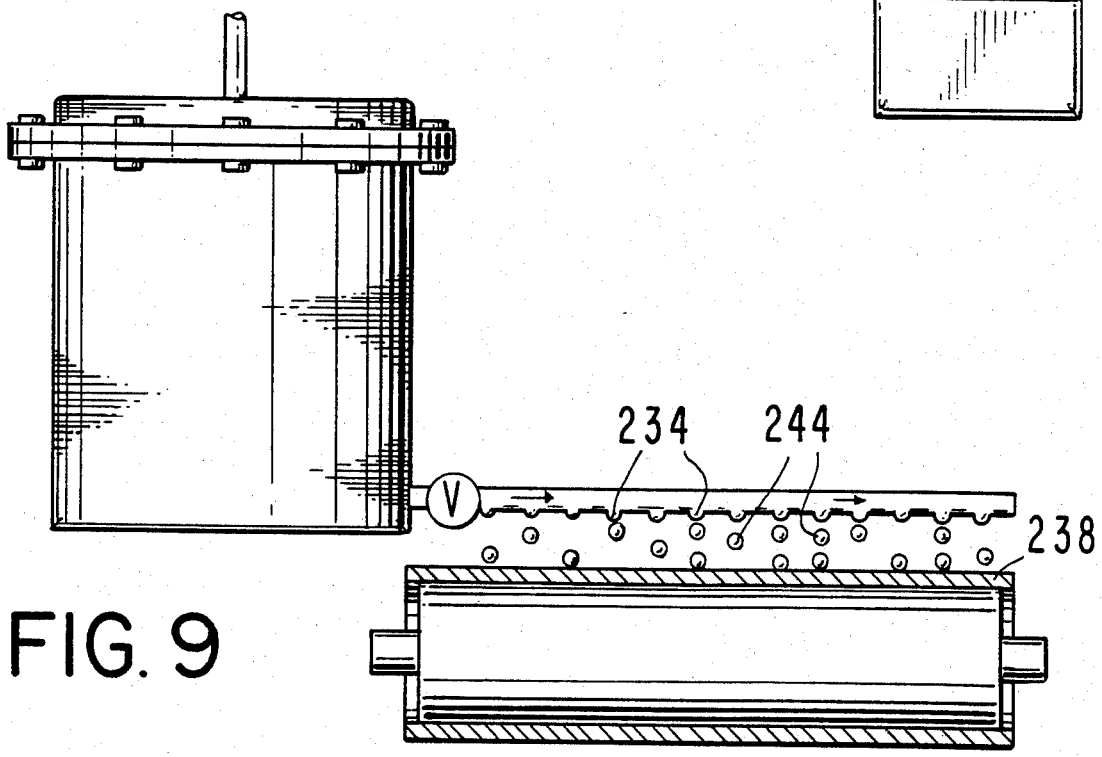
FIG. 9

USE IN AUGMENTING OR ENHANCING AROMA OF PERFUMED ARTICLE WITH ACYLOXY ALKANOLS AND ESTERS THEREOF

This is a divisional of application Ser. No. 396,487, filed July 8, 1982, now abandoned.

BACKGROUND OF THE INVENTION

The present invention relates to oxyneopentyl alkanoate derivatives defined according to the structure:

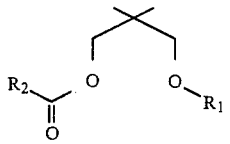

wherein $R_1$ represents hydrogen or acetyl and $R_2$ represents $C_1$–$C_3$ lower alkyl produced by the novel process of my invention and to novel compositions using one or more of such oxyneopentyl alknaoate derivatives to alter, modify or enhance the flavor and/or aroma of consumable materials or impart flavor and/or aroma to consumable materials.

There has been considerable work performed relating to substances which can be used to impart (modify, augment or enhance) flavors and fragrances to (or in) various consumable materials. These substances are used to diminish the use of natural materials, some of which may be in short supply, and to provide more uniform properties in the finished product.

Fruity, strawberry-like, spearmint, rum-like, cherry, creamy, spearmint, butterscotch, raspberry-like, rum-like and sweet aroma and taste nuances are particularly desirable for many uses in foodstuff flavors, chewing gum flavors, toothpaste flavors, medicinal product flavors and chewing tobacco flavors; particularly in the area of tropical fruit flavors, rum flavors, dairy flavors, raspberry jam flavors, and strawberry jam flavors.

Fruity (peachy/raspberry), seedy, beta-ionone-like, "jammy", woody, piney and Virginia tobacco-like aroma nuances with linalool and oxyphenolon-like top-notes are highly desirable in several types of perfume compositions, perfumed articles and colognes.

Virginia tobacco-like aroma and taste nuances prior to and on smoking in the main stream and in the side stream are highly desirable in smoking tobacco compositions and smoking tobacco articles containing same.

The oxyneopentyl alkanoate derivatives are known compounds and are described in the U.S. Pat. No. 4,017,537 issued on Apr. 12, 1977 (class 260, subclass 494) at column 4, line 1–30. The organoleptic properties which these compounds, have however are not disclosed therein.

Thus, nothing in the prior art indicates oxyneopentyl alkanoate derivatives or chemicals having structures similar thereto as being useful for their organoleptic properties.

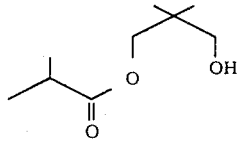

Figure 2:
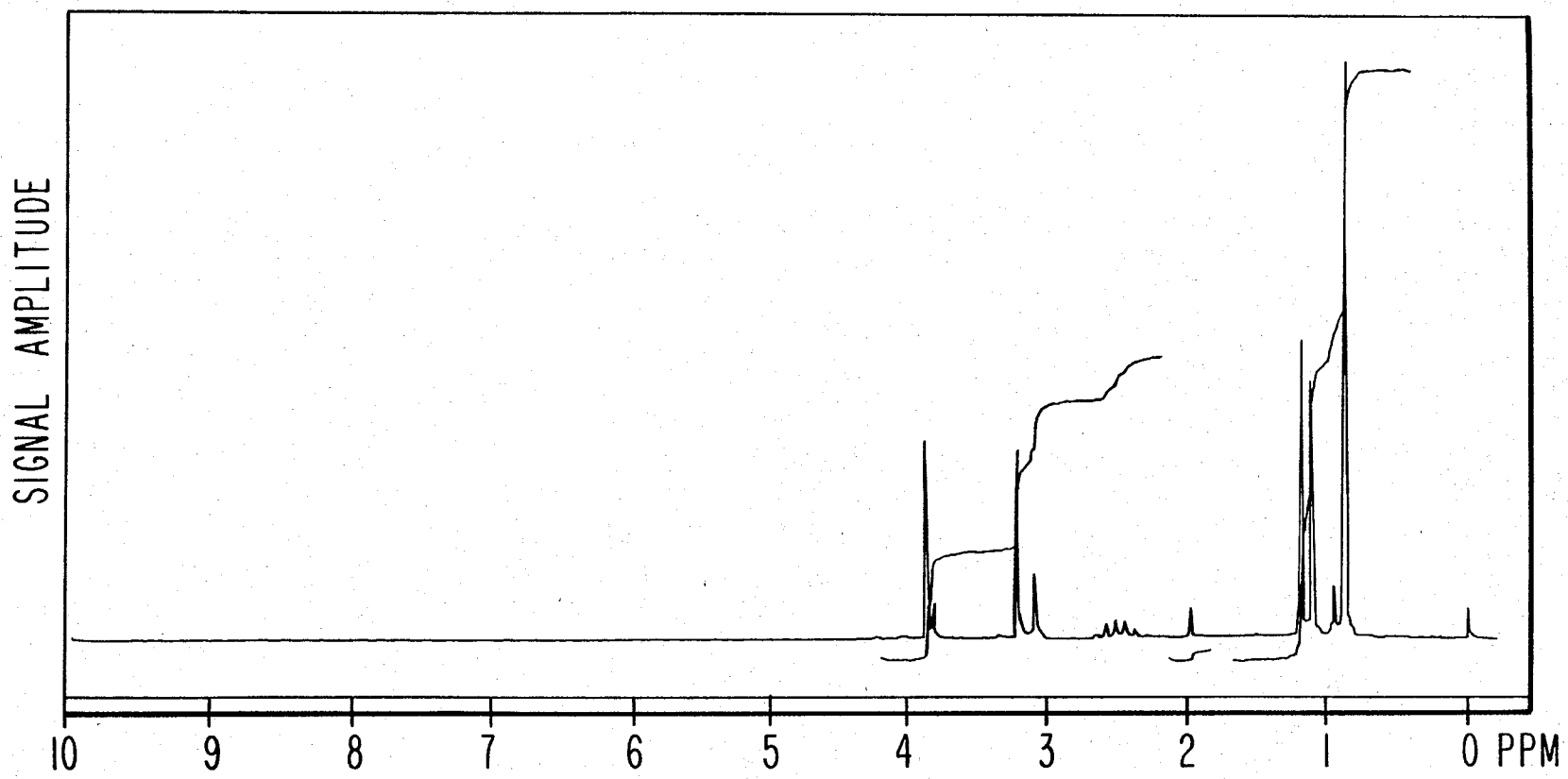

FIG. 2 is the NMR spectrum for the crude reaction product of Example I containing the compound having the structure:

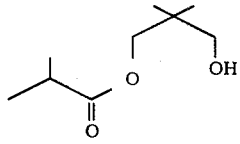

(solvent: $CFCl_3$; field strength: 100 MHz).

Figure 3:
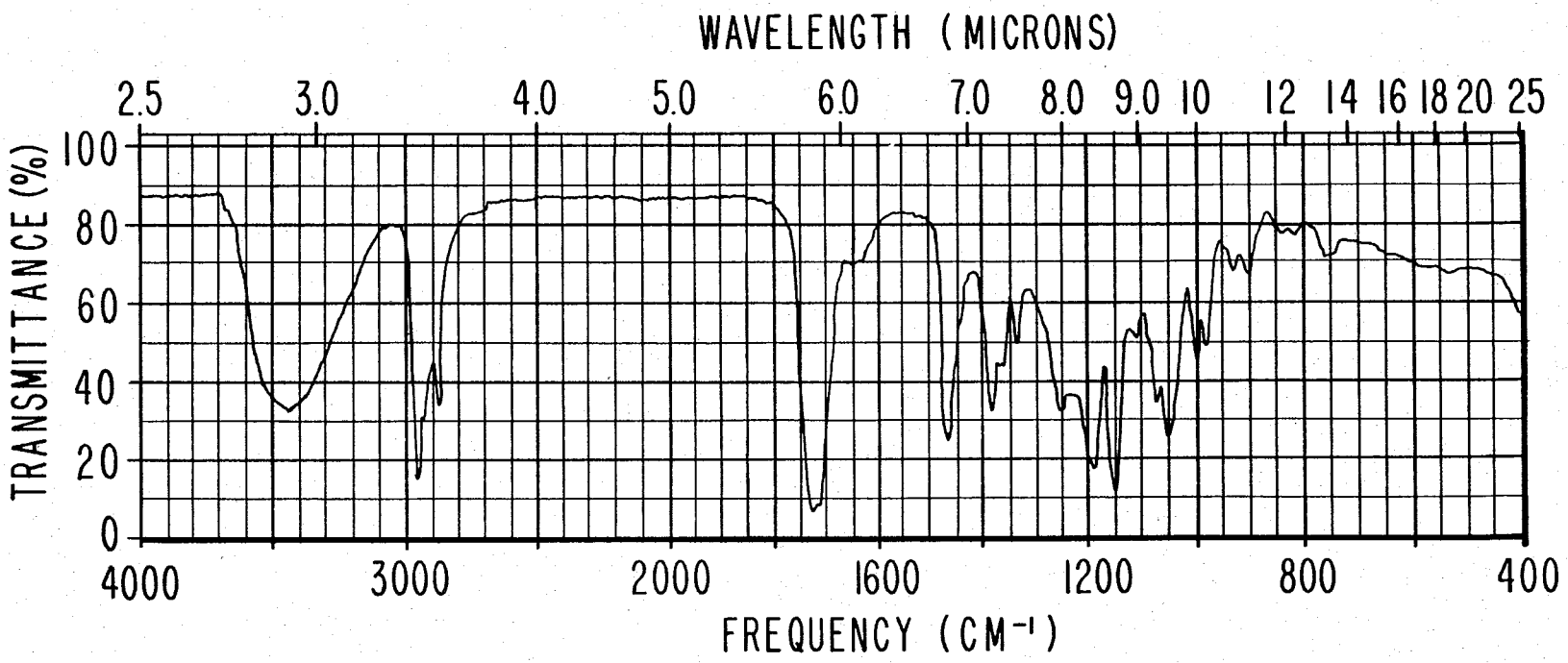

FIG. 3 is the infra-red spectrum for the crude reaction product of Example I containing the compound having the structure:

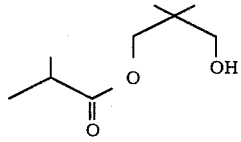

Figure 4:
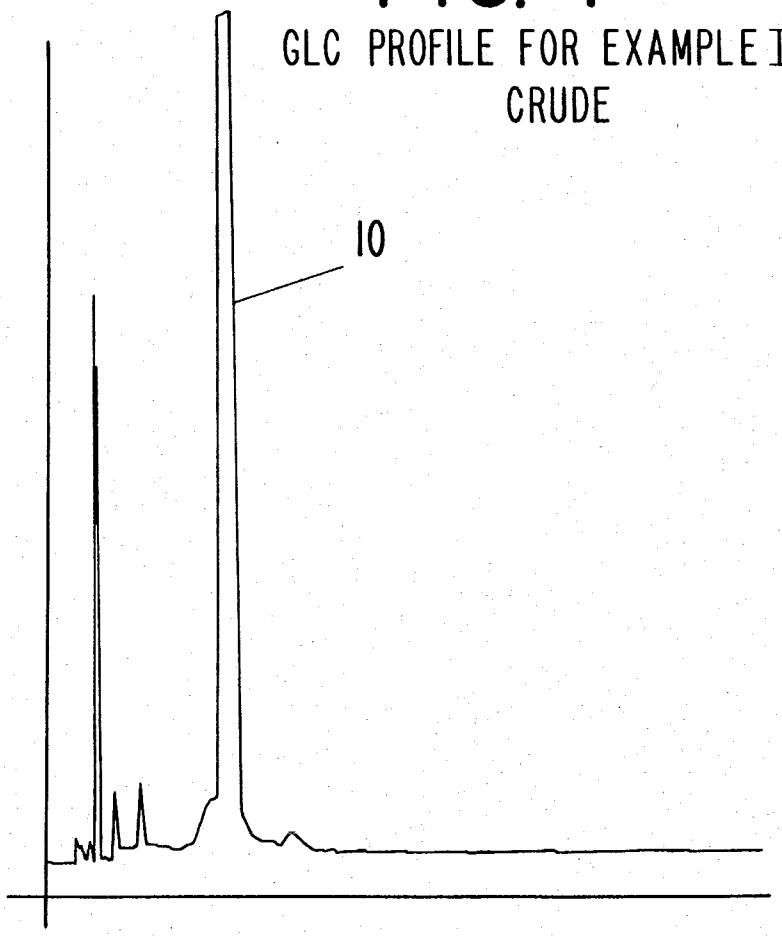

FIG. 4 is the GLC profile for the crude reaction product of Example II(a) containing the compound having the structure:

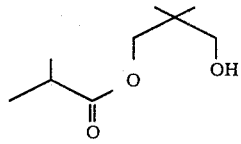

(conditions: SE-30, col. programmed at 200° C., isothermal).

Figure 5:
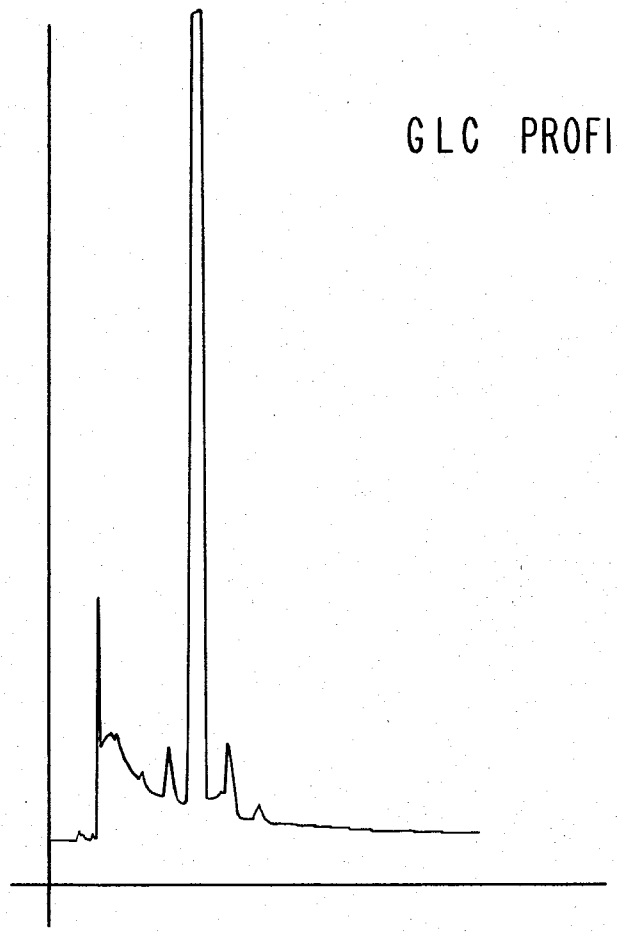

FIG. 5 is the GLC profile for the crude reaction product of Example II(b) having the structure:

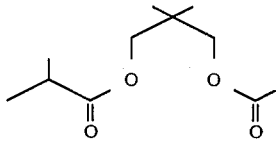

(conditions: SE-30, col. programmed at 200° C., isothermal).

Figure 6:
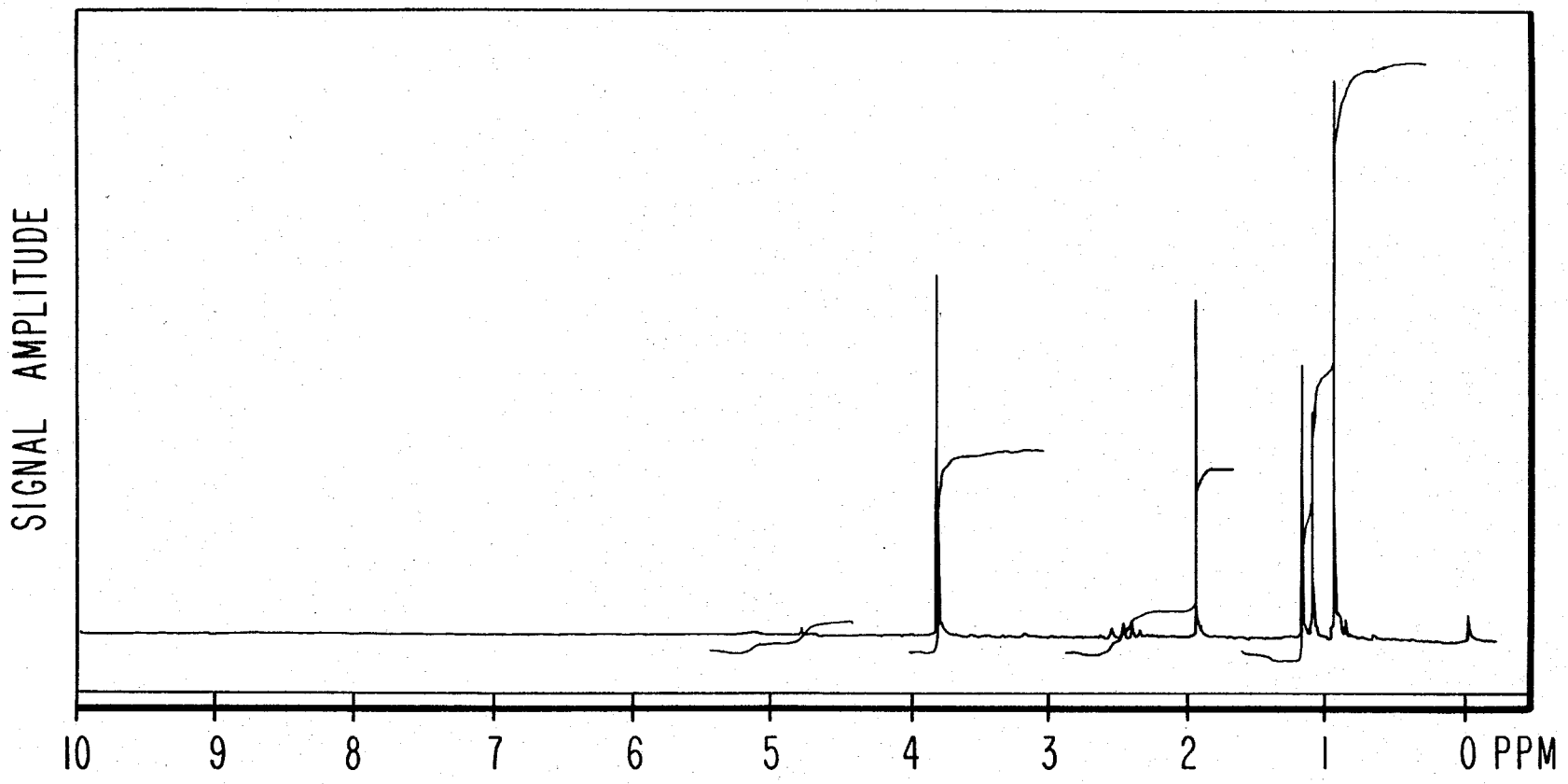

FIG. 6 is the NMR spectrum for the crude reaction product of Example II(b) having the structure:

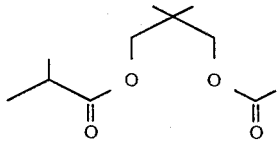

(solvent: $CFCl_3$; field strength 100 MHz).

Figure 7:
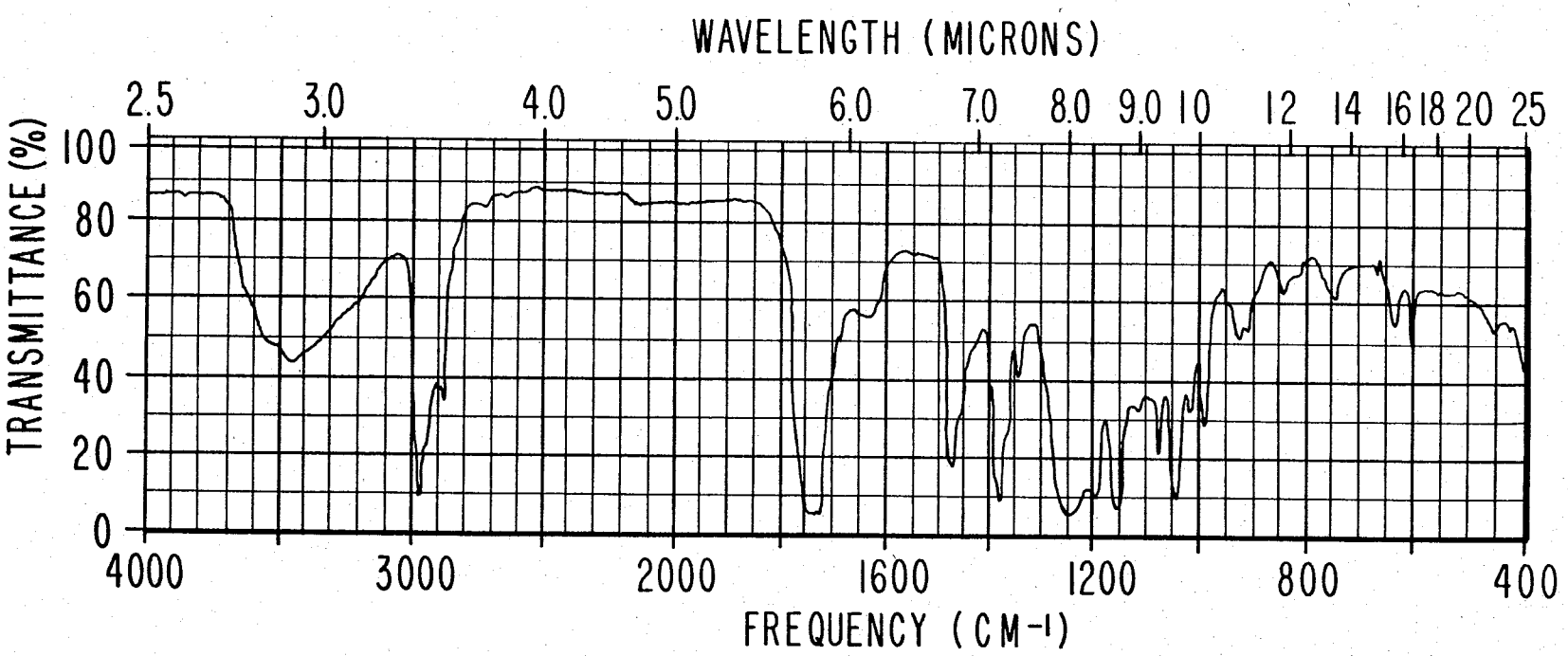

FIG. 7 is the infra-red spectrum for the crude reaction product of Example II(b) containing the compound having the structure:

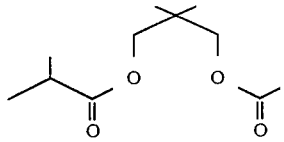

FIG. 8 is a partial side elevation view and partial sectional view of an apparatus for forming polyethylene pellets scented with the aromatizing materials of my invention.

FIG. 9 is a section taken on line 9—9 of FIG. 8.

DETAILED DESCRIPTION OF THE DRAWINGS

FIG. 4 is the GLC profile for the crude reaction product of Example II(a) containing the compound having the structure:

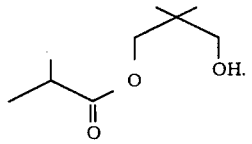

The peak indicated by reference "10" is the peak for the compound having the structure:

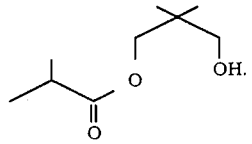

THE INVENTION

It has now been discovered that novel solid and liquid foodstuff, chewing gum, medicinal product, toothpaste and chewing tobacco compositions and flavoring compositions therefor having fruity, strawberry, spearmint-like, rum-like, cherry, creamy, sweet, butterscotch-like and raspberry-like aroma and taste characteristics; as well as a novel smoking tobacco and smoking tobacco flavoring compositions having Virginia tobacco-like aroma and taste prior to and on smoking, both in the main stream and the side stream; as well as a novel perfume compositions, colognes and perfumed articles (e.g., solid or liquid anionic, cationic, nonionic or zwitterionic detergents; fabric softeners, drier-added fabric softener articles, perfumed polymers, hair preparations, bath preparations and cosmetic powders) having intense and long lasting fruity (peachy/raspberry) seedy, beta-ionone-like, "jammy", woody, piney and Virginia tobacco-like aroma nuances with linalool, oxyphenylon-like and angelica lactone-like topnotes may be provided by the utilization of one or more of the oxyneopentyl alkanoate derivatives having the generic structure:

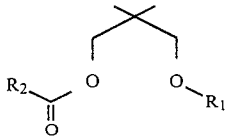

wherein $R_1$ represents hydrogen or acetyl and $R_2$ represents $C_1$–$C_3$ lower alkyl in foodstuffs, chewing gum, toothpastes, medicinal products, perfume compositions, perfumed articles, colognes and smoking tobaccos as well as smoking tobacco substitutes.

The oxyneopentyl alkanoate derivatives of my invention may be produced by first reacting 2,2-dimethyl-1,3-dihydroxypropane having the structure:

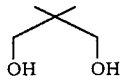

with an aldehyde having the structure:

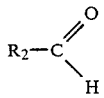

wherein $R_2$ represents $C_1$–$C_3$ lower alkyl according to the reaction:

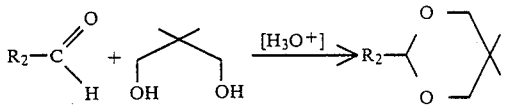

whereby the cyclic acetal defined according to the structure:

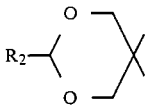

is formed. The cyclic acetal having the structure:

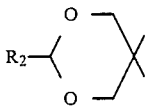

is then reacted with hypochlorous acid, or hypobromous acid or a precursor thereof (e.g., a mixture of acetic acid and sodium or potassium hypochlorite or hypobromite) to form a 1-acyloxy-3-hydroxy-2,2-dimethylpropane defined according to the structure:

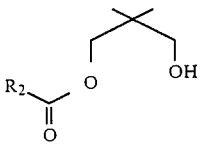

which may be used "as is" for its organoleptic properties or which may be further reacted with an acyl anhydride to form the compound of my invention having the structure:

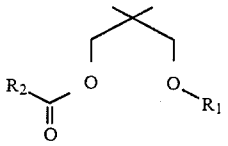

where the acyl anhydride is defined according to the structure:

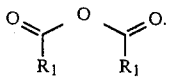

In the reaction:

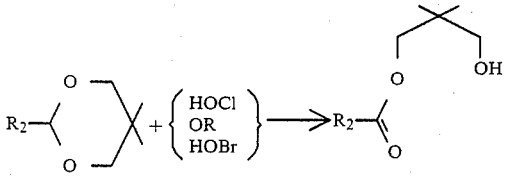

the mole ratio of hypochloride or hypobromite compound:cyclic acetal may vary from about 1:1 up to about 2:1 with a mole ratio of between 1.5:1 and 1.8:1 being preferred. The most preferred technique is to use a mixture of an alkali metal hypohalite such as sodium hypochlorite or sodium hypobromite or potassium hypochlorite or potassium hypobromite or lithium hypochlorite or lithium hypobromite or calcium hypochlorite with a dilute mineral acid or weak acid such as 0.01 moler hydrochlorite acid or acetic or glacial acetic acid. It is preferred that the ratio of acid:hypohalite salt is 1:1 or greater.

The temperature of reaction is preferred to be between 0° and 20° C. with the most preferred temperature range being 10°-15° C. Higher temperatures will give rise to undesired side products and lower temperature will give rise to inordinately long times of reaction.

Insofar as the reaction to form the diester is concerned, to wit:

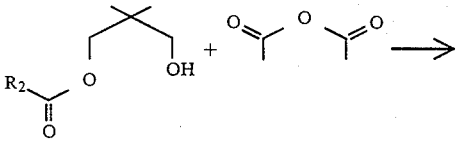

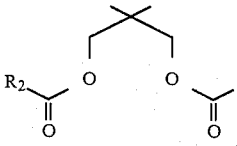

it is preferred that the reaction temperature be in the range of 90°-150° C. at from atmospheric pressure up to 10 atmospheres pressure. The mole ratio of acyl anhydride having the structure:

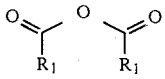

to the compound having the structure:

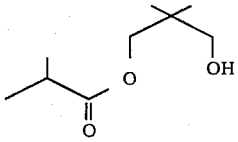

may vary from about 1:1 up to about 2:1 with a mole ratio of about 1.1:1 being preferred.

At the end of the reactions, the reaction mass may be "worked up as by routine washing, neutralization of excess reactants and fractional distillation.

Referring to FIGS. 8 and 9, the apparatus used in producing polymeric fragrances comprises a device for forming scented polyolefin (for example) pellets which comprises a vat or container 210 into which a mixture of polyolefins such as polyethylene and an aromatic substance or scented material is placed (in this case, the compounds having the structures:

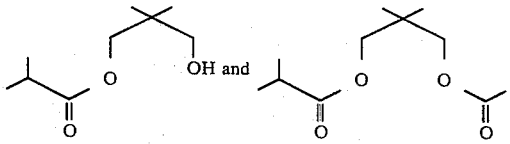

as well as perfume compositions containing same of my invention). The container is closed by an air-tight lid 228, clamped to the container by bolts 265. The stirrer 273 traverses the lid or cover 228 in air tight manner and is rotated in a suitable manner. A surrounding cylinder 212 having heating coils which are supplied with electric current through cable 224 from a rheostat or control 216 is operated to maintain the temperature inside the container 210 such that polyethylene or other thermoplastic polymer in the container will be maintained in the molten or liquid state. It has been found advantageous to employ a colorless, odorless polymer (e.g., polyethylene) with a viscosity ranging between 180 and 220 Saybolt seconds and having a melting point in the range of 200°-280° F. The heater 220 is operated to maintain the upper portion of the container 210 within a temperature range of from 250°-350° F. The bottom portion of the container 218 is heated by means of heating coils 222 heated through a control 220 connected thereto through a connecting wire 226 to maintain the lower portion of the container 218 within a temperature range of from 250°-350° F.

Thus, polymer (e.g. polyolefin) added to the container 210 is heated from 10-12 hours whereafter a scent or aroma imparting material (the mixture of aldehydes to create the fresh air aroma) is quickly added to the melt. The material must be compatible with polyolefin and forms a homogeneous liquid melt therewith. The scented material is of a type for the particular aroma desired and formulated specifically for the scenting purpose for which the polyolefin will be employed. The heat resisting coils and aromatic materials in some instance in solid or powdered form may be employed and added to the polyolefin in the container 210. Generally about 10–30% by weight of scenting material are added to the polyolefin.

After the scent imparting material is added to the container 210, the mixture is stirred for a few minutes, for example 5–15 minutes, and maintained within the temperature ranges indicated previously by the heating coils 212 and 218, respectively. The controls 216 and 220 are connected through cables 224 and 226 to a suitable supply of electric current for supplying the power for heating purposes.

Thereafter, the valve "V" is opened permitting the mass to flow outward through conduit 232 having a multiplicity of orifices 234 adjacent to the lower side thereof. The outer and of the conduit 232 is closed so that the liquid polymer (e.g. polyolefin) and aroma mixture will continuously drop through the orifices 234 downwardly from the conduit 232. During this time, the temperature of the polymer (e.g. polyolefin) and aroma mixture in the container 210 is accurately controlled so that a temperature in the range of from about 210°–275° F. will exit in the conduit 232. The regulation of the temperature through the control 216 and the control 220 is essential in order to insure temperature balance to provide for the continuous dropping or dripping of molten polymer (e.g. polyolefin) and scenting (that is mixture of aldehydes) mixture through the orifices 234 at a range which will insure the formation of droplets 236 which will fall downwardly onto a moving conveyor belt 238 trained to run between conveyor wheels 240 and 242 beneath the conduit 232.

When the droplets 236 fall onto the conveyor 238, they form pellets 244 which harden almost instantaneously and fall off the end of the conveyor 238 into a container 259 which is advantageously filled with water or some other suitable cooling liquid to insure the rapid cooling of each of the pellets. The pellets 244 are then collected from the container 259 and utilized in a process as illustrated infra.

A feature of this aspect of the process of our invention is the provision for moistening the conveyor belt 238 to insure rapid formation of the solid polymer (e.g. polyolefin) scented pellets 244 without sticking to the belt. The belt 238 is advantageously of a material which will not normally stick to a melted plastic but the moistening means 248 insures a sufficiently cold temperature of the belt surface for the adequate formation of the pellets 244. The moistening means comprises a container 259 which is continuously fed with water 252 to maintain a level 254 for moistening a sponge element 256 which bears against the exterior surface of the belt 238.

It is preferred that the pH of the reaction:

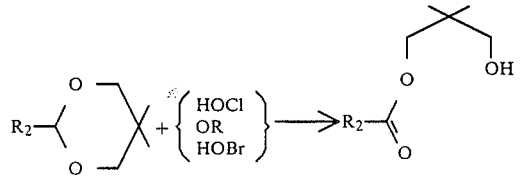

be carried out at about 7. Thus, in the event, that an alkali metal hypohalite is used with acetic acid, for example, the use of an alkali metal phosphate buffer is useful (but not necessary) in order to facilitate adjustment of the pH of the reaction mass to about 7.

In preparing the compounds defined according to the structure:

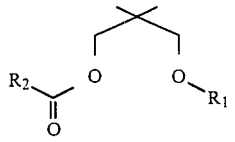

wherein $R_1$ is acetyl and $R_2$ is $C_1$–$C_3$ lower alkyl, the product may be prepared according to the reaction:

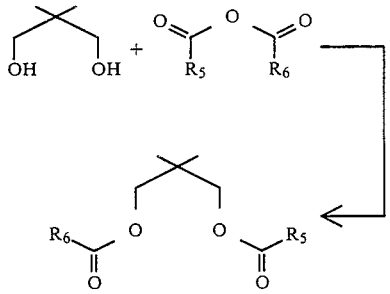

or according to the reaction:

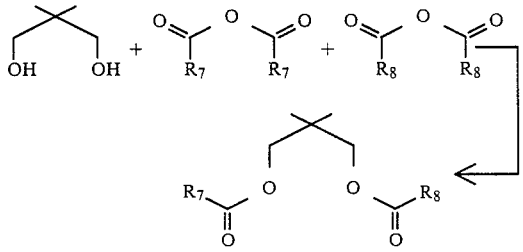

wherein one of $R_5$ or $R_6$ is methyl and the other of $R_5$ or $R_6$ is $C_1$–$C_3$ lower alkyl. An example of this reaction is the following reaction:

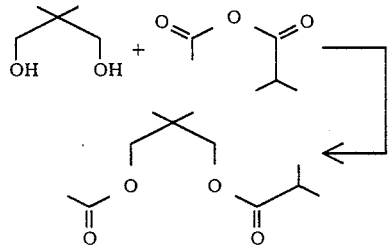

wherein the mixed isobutyric acetic anhydride is reacted with 1,3-dihydroxy-2,2-dimethyl propane.

In the alternative, a mixture of alkanoic acid anhydride may be reacted with 1,3-dihydroxy-2,2-dimethyl propane according to the reaction:

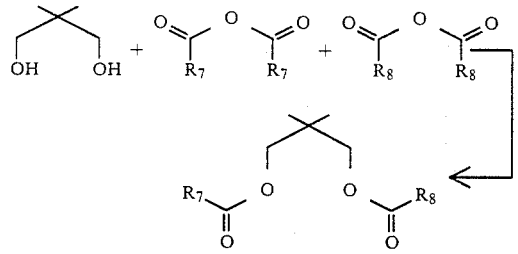

wherein one of $R_7$ or $R_8$ is metal and the other of $R_7$ or $R_8$ is $C_1$–$C_3$ lower alkyl. An example of this reaction is the reaction:

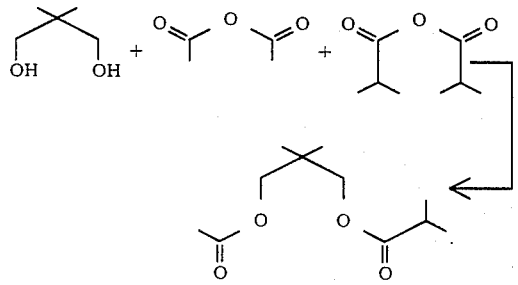

In the reaction:

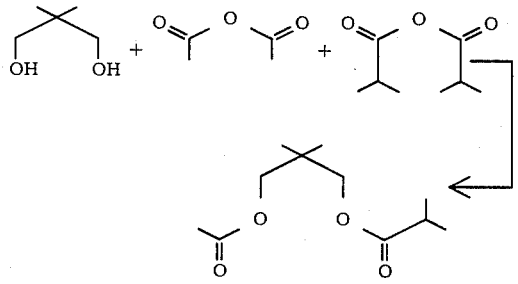

the mole ratio of acetic anhydride:1,3-dihydroxy-2,2-dimethyl propane is about 0.5:1 and the mole ratio of diisobutyric anhydride:acetic anhydride is about 1:1.

In the reaction:

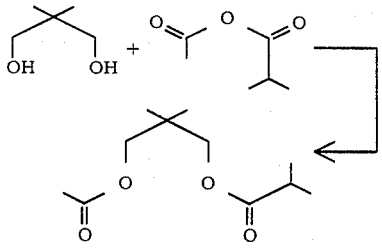

the mole ratio of the mixed isobutyric-acetic anhydride:1,3-dihydroxy-2,2-dimethyl propane is about 1:1 with a slight excess of isobutyric-acetic mixed anhydride being preferred.

The following Table I sets forth examples of products covered by my invention and the organoleptic properties thereof:

TABLE I

| Structure of Reaction Product | Perfume Properties | Food Flavor Properties |
|---|---|---|
| 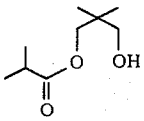 | A fruity aroma with linalool-like topnotes. | A fruity, strawberry-like and spearmint aroma profile with a cherry, fruity, strawberry-like, creamy and spearmint taste profile at 5 ppm. |
| 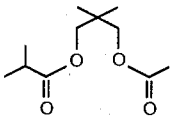 | A fruity (peachy/raspberry), seedy, beta-ionone-like, jammy, woody, piney and Virginia tobacco-like aroma profile with angelical lactone-like and oxyphenolon-like topnotes. | A fruity, rum-like aroma profile with a sweet, fruity, rum-like, and butterscotch taste profile. |

When the oxyneopentyl alkanoate derivatives of my invention are used as food flavor adjuvants, the nature of the co-ingredients included with each of the said oxyneopentyl alkanoate derivatives in formulating the product composition will also serve to alter, modify, augment or enhance the organoleptic characteristics of the ultimate foodstuff treated therewith.

As used herein in regard to flavors, the terms "alter", "modify" and "augment" in their various forms means "supplying or imparting flavor character or note to otherwise bland, relatively tasteless substances or augmenting the existing flavor characteristic where a natural flavor is deficient in some regard or supplementing the existing flavor impression to modify its quality, character or taste".

The term "enhance" is used herein to mean the intensification of a flavor or aroma characteristic or note without the modification of the quality thereof. Thus, "enhancement" of a flavor or aroma means that the enhancement agent does not add any additional flavor note.

As used herein, the term "foodstuff" includes both solid and liquid ingestible materials which usually to, but need not, have nutritional value. Thus, foodstuffs include soups, convenience foods, beverages, dairy products, candies, vegetables, cereals, soft drinks, snacks and the like.

As used herein, the term "medicinal product" includes both solids and liquids which are ingestible non-toxic materials which have medicinal value such as cough syrups, cough drops, aspirin and chewable medicinal tablets.

The term "chewing gum" is intended to mean a composition which comprises a substantially water-insoluble, chewable plastic gum base such as chicle, or substitutes therefor, including jelutong, guttakay, rubber or certain comestible natural or synthetic resins or waxes. Incorporated with the gum base in admixture therewith may be plasticizers of softening agents, e.g., glycerine; and a flavor composition which incorporates one or more of the oxyneopentyl alkanoate derivatives of my invention, and in addition, sweetening agents which may be sugars, including sucrose or dextrose and/or artificial sweeteners such as cyclamates or saccharin. Other optional ingredients may also be present.

Substances suitable for use herein as co-ingredients or flavoring adjuvants are well known in the art for such use, being extensively described in the relevant literature. It is a requirement that any such material be "ingestibly" acceptable and thus non-toxic and otherwise non-deleterious particularly from an organoleptic standpoint whereby the ultimate flavor and/or aroma of the consumable material used is not caused to have unacceptable aroma and taste nuances. Such materials may in general be characterized as flavoring adjuvants or vehicles, comprising broadly stabilizers, thickeners, surface active agents, conditioners, other flavorants and flavor intensifiers.

Stabilizer compounds include preservatives, e.g., sodium chloride; antioxidants, e.g., calcium and sodium ascorbate, ascorbic acid, butylated hydroxyanisole (mixture of 2- and 3-tertiary-butyl-4-hydroxyanisole), butylated hydroxytoluene (2,6-di-tertiary-butyl-4-methylphenol), propyl gallate and the like and sequestrants, e.g., citric acid.

Thickener compounds include carriers, binders, protective colloids, suspending agents, emulsifiers and the like, e.g., agar agar, carrageenan; cellulose and cellulose derivatives such as carboxymethyl cellulose and methyl cellulose; natural and synthetic gums such as gum arabic, gum tragacanth; gelatin, proteinaceous materials; lipids; carbohydrates; starches; pectins and emulsifiers, e.g., mono- and diglycerides of fatty acids, skim milk powder, hexoses, pentoses, disaccharides, e.g., sucrose corn syrup and the like.

Surface active agents includes emulsifying agents, e.g., fatty acids such as capric acid, caprylic acid, palmitic acid, myristic acid and the like, mono- and diglycerides of fatty acids, lecithin, defoaming and flavor-dispersing agents such as sorbitan monostearate, potassium stearate, hydrogenated tallow alcohol and the like.

Conditioners include compounds such as bleaching and maturing agents, e.g., benzoyl peroxide, calcium peroxide, hydrogen peroxide and the like; starch modifiers such as peracetic acid, sodium chlorite, sodium hypochlorite, propylene oxide, succinic anhydride and the like, buffers and neutralizing agents, e.g., sodium acetate, ammonium bicarbonate, ammonium phosphate, citric acid, lactic acid, vinegar the like; colorants, e.g., carminic acid, cochineal, tumeric and curcuma and the like; firming agents such as aluminum sodium sulfate, calcium chloride and calcium gluconate; texturizers, anti-caking agents, e.g., aluminum calcium sulfate and tribasic calcium phosphate; enzymes; yeast foods, e.g., calcium lactate and calcium sulfate; nutrient supplements, e.g., iron salts such as ferric phosphate, ferrous gluconate and the like, riboflavin, vitamins, zinc sources such as zinc chloride, zinc sulfate and the like.

Other flavorants and flavor intensifiers include aldehydes, esters, natural oils, alcohols, sulfides, ketones, lactones, carboxylic acids and hydrocarbons such as haliotropin, terpinenol-4, benzaldehyde, anisaldehyde, phenyl acetaldehyde, benzyl formate, benzyl acetate, cis-3-hexenyl benzoate, methyl hexanoate, hexanal, eucalyptol, eugenol, acetaldehyde, ethyl acetate, ethyl butyrate, turpentine gum oil, limonene, gum camphor, isobornyl acetate, borneol, cinnamic aldehyde, cuminic aldehyde, furfural, methyl cinnamate, cassia oil, vanillin, maltol, parahydroxybenzyl acetate, dimethyl sulfide, alphaionone, acetic acid, isobutyl acetate, acetone, butyric acid, formic acid, valeric acid, amyl acetate, amyl butyrate, anethol, benzyl salicylate, diacetyl, dimethyl anthranilate, ethyl methylphenylglycidate, ethyl succinate, ethyl valerate, geraniol, cis-3-hexen-1-ol, 2-hexenyl acetate, 2-hexenyl butyrate, hexyl butyrate, 4-(p-hydroxyphenyl)-2-butanone, betaionone, isobutyl cinnamate, jasmine, lemon essential oil, methyl butyrate, methyl caproate, methyl disulfide, methyl p-naphthyl ketone, orris butter, rose absolute, terpenyl acetate, gamma-undecalactone.

The specific flavoring adjuvant selected for use may be either solid or liquid depending upon the desired physical form of the ultimate product, i.e., foodstuff, whether simulated or natural, and should, in any event, (i) be organoleptically compatible with the oxyneopentyl alkanoate derivatives of my invention by not covering or spoiling the organoleptic properties (aroma and/or taste) thereof; (ii) be non-reactive with the oxyneopentyl alkanoate derivatives of my invention and (iii) be capable of providing an environment in which the oxyneopentyl alkanoate derivatives can be dispersed or admixed to provide a homogeneous medium. In addition, selection of one or more flavoring adjuvants, as well as the quantities thereof will depend upon the precise organoleptic character desired in the finished product. Thus, in the case of flavoring compositions, ingredient selection will vary in accordance with the foodstuff, chewing gum, medicinal product or toothpaste to which the flavor and/or aroma are to be imparted, modified, altered or enhanced. In contradistinction, in the preparation of solid products, e.g., simulated foodstuffs, ingredients capable of providing normally solid compositions should be selected such as various cellulose derivatives.

As will be appreciated by those skilled in the art, the amount of oxyneopentyl alkanoate derivatives employed in a particular instance can vary over a relatively wide range, depending upon the desired organoleptic effects to be achieved. Thus, correspondingly, greater amounts would be necessary in those instances wherein the ultimate food composition to be flavored is relatively bland to the taste, whereas relatively minor quantities may suffice for purposes of enhancing the composition merely deficient in natural flavor or aroma. The primary requirement is that the amount selected to be effective, i.e., sufficient to alter, modify, or enhance the organoleptic characteristics of the parent composition, whether foodstuff per se, chewing gum, per se, medicinal product per se, toothpaste per se, or flavoring composition.

The use of insufficient quantities of oxyneopentyl alkanoate derivatives will, of course, substantially vitiate any possibility of obtaining the desired results while excess quantities prove needlessly costly and, in extreme cases, may disrupt the flavor-aroma balance, thus proving self-defeating.

Accordingly, the terminology "effective amount" and "sufficient amount" is to be accorded a significance in the context of the present invention consisitent with the obtention of desired flavoring effects.

Thus, and with respect to ultimate food compositions, chewing gum compositions, medicinal product compositions and toothpaste compositions, it is found that quantities of oxyneopentyl alkanoate derivatives ranging from a small but effective amount, e.g., 0.01 parts per million up to about 100 parts per million based on total composition are suitable. Concentrations in excess of the maximum quantity stated are not normally recommended, since they fail to prove commensurate enhancement of organoleptic properties. In those instances, wherein the oxyneopentyl alkanoate derivatives are added to the foodstuff as an integral component of a flavoring composition, it is, of course, essential that the total quantity of flavoring composition employed be sufficient to yield an effective oxyneopentyl alkanoate derivative concentration in the foodstuff product.

Food flavoring compositions prepared in accordance with the present invention preferably contain the oxyneopentyl alkanoate derivatives in concentrations ranging from about 0.01% up to about 15% by weight based on the total weight of the said flavoring composition.

The composition described herein can be prepared according to conventional techniques well known as typified by cake batters and fruit drinks and can be formulated by merely admixing the involved ingredients within the proportions stated in a suitable blender to obtain the desired consistency, homogeneity of dispersion, etc. Alternatively, flavoring compositions in the form of particulate solids can be conveniently prepared by mixing the oxyneopentyl alkanoate derivatives with, for example, gum arabic, gum tragacanth, carrageenan and the like, and thereafter spray-drying the resultant mixture whereby to obtain the particular solid product. Preprepared flavor mixes in powder form e.g., a fruit-flavored powder mix are obtained by mixing the dried solid components, e.g., starch sugar and the like and oxyneopentyl alkanoate derivatives in a dry blender until the requisite degree of uniformity is achieved.

It is presently preferred to combine with the oxyneopentyl alkanoate derivatives of my invention, the following adjuvants:

Heliotropin;
Terpinenol-4;
Benzaldehyde;
Anisaldehyde;
Phenylacetaldehyde;
Benzyl formate;
Benzyl acetate;
Cis-3-hexenyl benzoate;
Methyl hexanoate;
Hexanal;
Eucalyptol;
Eugenol;
Acetaldehyde;
Ethyl acetate;
Ethyl butyrate;
Turpentine gum oil;
Limonene;
Gum camphor;
Isobornyl acetate;
Borneol;
Cinnamic aldehyde;
Cuminic aldehyde;
Furfural;
Methyl cinnamate;
Cassia oil;
Vanillin;
Malto;
Parahydroxybenzylacetone;
Dimethyl sulfide;
Alpha-ionone;
Acetic acid;
Isobutyl acetate;
Acetone;
Butyric acid;
Formic acid;
Valeric acid;
Amyl acetate;
Amyl butyrate;
Anethol;
Benzyl salicylate;
Diacetyl;
Dimethyl anthranilate;
Ethyl methylphenylglycidate;
Ethyl succinate;
Ethyl valerate;
Geraniol;
Cis-3-hexen-1-ol;
2-Hexenyl acetate;
2-Hexenyl butyrate;
Hexyl butyrate;
4-(p-Hydroxyphenyl)-2-butanone;
Beta-ionone;
Isobutyl cinnamate;
Jasmine;
Lemon essential oil;
Methyl butyrate;
Methyl capronate;
Methyl disulfide;
Methyl p-naphthyl ketone;
Orris butter;
Rose absolute;
Terpenyl acetate;
Gamma-undecalactone;
Vanilla; and
alchol.

An additional aspect of my invention provides an organoleptically improved smoking tobacco product and additives therefor, as well as methods of making the same which overcome desired problems heretofore encountered in which desired Virginia tobacco-like, fruity, cherry-like flavor characteristics of natural tobacco (prior to smoking and, on smoking, in the main stream and in the side stream) are created or enhanced or modified or augmented and may be readily controlled and maintained at the desired uniform level regardless of variations in the tobacco components of the blend.

This invention further provides improved tobacco additives and methods whereby desirable natural aromatic tobacco flavoring characteristics with fruity, cherry-like, sweet, woody, Virginia tobacco-like notes may be imparted to smoking tobacco products and may be readily varied and controlled to produce the desired uniform flavoring characteristics.

In carrying out this aspect of my invention, I added to smoking tobacco materials or a suitable substitute therefor (e.g., dried lettuce leaves) an aroma and flavor additive containing as an active ingredient one or more oxyneopentyl alkanoate derivatives of my invention.

In addition to the oxyneoprentyl alkanoate derivatives of my invention other flavoring and aroma additives may be added to the smoking tobacco material or substitute therefor either separately to in admixture with the oxyneopentyl alkanoate derivatives as follows:

I. Synthetic Materials

Beta-ethyl-cinnamaldehyde;
Eugenol;
Dipentene;
Damascenone;
Maltol;
Ethyl maltol;
Delta undecalactone;
Delta decalactone;

Benzaldehyde;
Amyl acetate;
Ethyl butyrate;
Ethyl valerate;
Ethyl acetate;
2-Hexenol-1;
2-Methyl-5-isopropyl-1,3-nonadiene-8-one;
2,6-Dimethyl-2,6-undecadiene-10-one;
2-Methyl-5-isopropylacetophenone;
2-Hydroxy-2,5,5,8a-tetramethyl-1-(2-hydroxyethyl)-decahydronaphthalene;
Dodecahydro-3a,6, 6,9a-tetramethylnaphtho-(2,1-b-)-furan
4-Hydroxyhexanoic acid, gamma lactone; and
Polyisoprenoid hydrocarbons defined in Example V of U.S. Pat. No. 3,589,372, issued on June 29, 1971.

II. Natural Oils

Celery seed oil;
Coffee extract;
Bergamot oil;
Cocoa extract;
Nutmeg oil; and
Origanum oil.

An aroma and flavoring concentrate containing one or more oxyneopentyl alkanoate of my invention and, if desired, one or more of the above indicated additional flavoring additives may be added to the smoking tobacco material, to the filter or to the leaf or paper wrapper. The smoking tobacco material may be shredded, cured, cased and blended tobacco material or reconstituted tobacco material or tobacco substitutes (e.g., lettuce leaves) or mixtures thereof. The proportions of flavoring additives may be varied in accordance with taste but insofar as enhancement or the imparting of fruity and/or cherry-like and/or Virginia tobacco-like and/or woody notes, I have found that satisfactory results are obtained if the proportion by weight of the sum total of oxyneopentyl alkanoate derivative(s) to smoking tobacco material is between 50 ppm and 1,500 ppm (0.005%–0.15%). I have further found that satisfactory results are obtained if the proportions by weight of the sum total of oxyneopentyl alkanoate derivative used to flavoring material is between 1,500 and 15,000 ppm (0.15%–1.5%).

Any convenient method for incorporating the oxyneopentyl alkanoate derivative(s) into the tobacco product may be employed. Thus, the oxyneopentyl alkanoate derivative(s) taken alone or along with other flavoring additives may be dissolved in a suitable solvent such as ethanol, diethyl ether and/or volatile organic solvents and the resulting solution may either be spread on the cured, cased and blended tobacco material or the tobacco material may be dipped into such solution. Under certain circumstances, a solution of the oxyneopentyl alkanoate derivative(s) taken alone or taken further together with other flavoring additives as set forth above, may be applied by means of a suitable applicator such as a brush or roller on the paper or leaf wrapper for the smoking product, or it may be applied to the filter by either spraying, or dipping, or coating.

Furthermore, it will be apparent that only a portion of the tobacco or substitute therefor need be treated and the thus treated tobacco may be blended with other tobaccos before the ultimate tobacco product is formed. In such cases, the tobacco is treated by using oxyneopentyl alkanoate derivative(s) in excess of the amounts or concentrations above indicated so that when blended with other tobaccos, the final product will have the percentage within the indicated range, supra.

In accordance with one specific example of my invention an aged, cured and shredded domestic burley tobacco is sprayed with a 20% ethanol solution of the compound defined according to the structure:

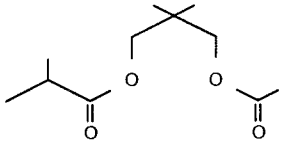

in an amount of compound to provide tobacco composition containing 800 ppm by weight of the compound having the structure:

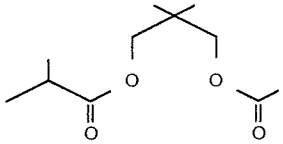

on a dry basis. Thereafter the alcohol is removed by evaporation and the tobacco is manufactured into cigarettes by the usual techniques. The cigarette when treated as indicated has a desired and pleasing aroma (intense Virginia tobacco-like) which is detectable in the main stream and the side stream when the cigarette is smoked. This aroma is described as being sweeter, more aromatic, more Virginia tobacco-like having sweet, fruity notes.

While my invention is particularly useful in the manufacture of smoking tobacco, such as cigarette tobacco, cigar tobacco and pipe tobacco, other tobacco products, formed from sheeted tobacco dust or fines may also be used. Likewise, the oxyneopentyl alkanoate derivative(s) of my invention can be incorporated with materials such as filter tip materials (e.g., cellulose acetate filters wherein fruity, woody, Virginia tobacco-like effects are desired), seam paste, packaging materials and the like which are used along with tobacco to form a product adapted for smoking. Furthermore, the oxyneopentyl alkanoate derivative(s) of my invention can be added to certain tobacco substitutes of natural or synthetic origin (e.g., dried lettuce leaves) and, accordingly, by the term "tobacco" as used throughout this specification is meant any composition intended for human consumption by smoking or otherwise, whether composed of tobacco plant parts, or substitute materials or both.

The oxyneopentyl alkanoate derivative(s) and one or more auxiliary perfume ingredients, including, for example, hydrocarbons, alcohols (other than the oxyneopentyl alkanoate derivatives of my invention), ketones, aldehydes, nitriles, esters (other than the oxyneopentyl alkanoate derivatives of my invention) lactones or cyclic esters, ethers, synthetic essential oils and natural essential oils, may be admixed so that the combined odors of the individual components produce a pleasant and desired fragrance, particularly and preferably in fruity, raspberry, peach-like, beta-ionone-like, piney, woody and tobacco-like fragrances. Such perfume compositions usually contain (a) the main note or the "bouquet" or foundation stone of the composition; (b) modifiers which round off and accompany the main note; (d) fixatives which include odorous substances which lend a particular note to the perfume throughout all stages of evaporation and substances which retard evaporation; and (d) topnotes which are usually low boiling fresh-smelling materials.

In perfume compositions, it is the individual components which contribute to their particular olfactory characteristics, however the overall sensory effect of the perfume composition will be at least the sum total of the effects of each of the ingredients. Thus, one or more of the oxyneopentyl alkanoate derivative(s) of my invention can be used to alter, modify or enhance the aroma characteristics of a perfume composition, for example, by utilizing or moderating the olfactory reaction contributed by another ingredient in the composition.

The amount of oxyneopentyl alkanoate derivative(s) of my invention which will be effective in perfume compositions as well as perfumed articles and colognes depends on many factors, including the other ingredients, their amounts and the effects which are desired. It has been found that perfume compositions containing as little as 0.01% of the oxyneopentyl alkanoate derivative(s) or even less (e.g., 0.005%) can be used to impart a fruity, raspberry, peachy, seedy, ionone-like, woody, piney and Virginia tobacco-like aroma profile to soaps, detergents (including anionic, nonionic, cationic or zwitterionic solid or liquid detergents), perfumed polymers (e.g., polyethylene or polypropylene or polyacrylates), cosmetics, fabric softeners, drier-added fabric softener articles, fabric whiteners, optical brighteners, hair preparations, bath preparations or other products. The amount employed can range up to 70% of the fragrance components and will depend on consideration of cost, nature of the end product, the effect desired on the finished product and the particular fragrance sought.

The oxyneoprentyl alkanoate derivative(s) of my invention are useful (taken alone or further together with other ingredients in the perfume compositions) in detergents and soaps, space odorants and deodorants, perfumes, colognes, toilet water, bath preparations, such as lacquers, brilliantines, pomades and shampoos; cosmetic preparations, such as creams, deodorants, hand lotions and sun screens; powders such as talcs, dusting powders, face-powders and the like. As little as 0.005% of the oxyneopentyl alkanoate derivative(s) of my invention (in the ultimate perfumed article) will suffice to impart an intense, long lasting fruity, raspberry, peach-like, beta-ionone-like, woody, piney and tobacco-like note to various types of perfumed articles. Generally no more than 3% of the oxyneopentyl alkanoate derivative(s) based on the ultimate end product (perfumed article) is required. Accordingly, the range of use of the oxyneopentyl alkanoate derivative(s) of my invention in the perfumed article is from about 0.005% up to about 3.0%.

In addition, the perfume composition or fragrance composition of my invention can contain a vehicle, or carrier for the oxyneopentyl alkanoate derivative(s). The vehicle can be a liquid such as a non-toxic alcohol, a non-toxic glycol or the like. Examples of a non-toxic alcohol is ethyl alcohol. Examples of a non-toxic glycol is 1,2-propylene glycol. The carrier can be an absorbent solid, such as a gum (e.g., gum arabic), or components for encapsulating the composition such as gelatin by means of coacervation or such as a urea-formaldehyde prepolymer when forming a polymer capsule around a liquid center).

It will thus be apparent that the oxyneopentyl alkanoate derivative(s) of my invention can be utilized to alter, modify, or enhance sensory properties, particularly organoleptic properties such as flavor(s) and/or fragrance(s) of a wide variety of consumable materials.

The following examples serve to illustrate processes for specifically producing the oxyneopentyl alkanoate derivative(s) useful in my invention.

The following examples also serve to illustrate specific embodiments of my invention.

It will be understood that these examples are illustrative and the invention is to be considered to be restricted thereto only as indicated in the appended claims.

All parts and percentages given herein are by weight unless otherwise specified.

EXAMPLE I

PREPARATION of 2,2-DIMETHYL-1,3-DIHYDROXYPENTANE-MONOISOBUTYRIC ACID ESTER

Reaction:

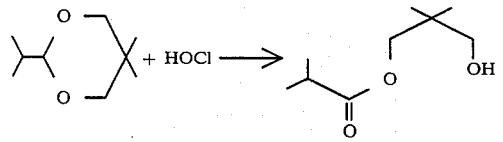

Into a 5 liter reaction flask equipped with stirrer, thermometer, reflux condensor, dropping funnel and cooling bath is placed 370 grams of acetic acid and 500 grams of the isobutylaldehyde neopentyl acetal having the structure:

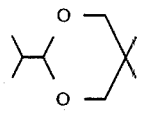

The reaction mass is cooled to 10°–15° C. and 2590 grams of 10% sodium hypochlorite aqueous solution is placed in the dropping funnel. Over a period of 3 hours while maintaining the reaction mass at 10°–15° C., the aqueous sodium hypochlorite solution is added dropwise to the reaction mass with stirring.

The reaction mass is then poured into 1 liter of a 10% aqueous sodium chloride solution. The reaction mass is then washed as follows:

(i) one time with 5% sodium hydroxide;

(ii) four times with 10% aqueous sodium chloride.

The reaction mass is then distilled to yield the following fractions:

| Fraction No. | Vapor Temp. (°C.) | Liquid Temp. (°C.) | Vacuum mm. Hg. Pressure | Reflux Ratio | Weight of Fraction |
|---|---|---|---|---|---|
| 1 | 53 | 90 | 0.7 | 9:1 | 6.8 |
| 2 | 79 | 112 | 0.7 | 9:1 | 25.9 |
| 3 | 95 | 112 | 0.7 | 9:1 | 21.4 |
| 4 | 95 | 122 | 0.6 | 9:1 | 26.3 |
| 5 | 96 | 110 | 7.5 | 9:1 | 20.9 |
| 6 | 93 | 108 | 7.5 | 9:1 | 21.6 |
| 7 | 93 | 108 | 7.5 | 9:1 | 19.1 |

-continued

| Fraction No. | Vapor Temp. (°C.) | Liquid Temp. (°C.) | Vacuum mm. Hg. Pressure | Reflux Ratio | Weight of Fraction |
|---|---|---|---|---|---|
| 8 | 93 | 108 | 7.5 | 9:1 | 23.3 |
| 9 | 93 | 108 | 7.5 | 9:1 | 18.7 |
| 10 | 97 | 105 | 7.5 | 9:1 | 22.8 |
| 11 | 91 | 105 | 7.5 | 9:1 | 22.6 |
| 12 | 91 | 107 | 7.5 | 9:1 | 26.3 |
| 13 | 91 | 125 | 7.5 | 9:1 | 27.6 |
| 14 | 92 | 175 | 7.5 | 9:1 | 18.3 |
| 15 | 80 | 230 | 7.0 | 9:1 | 19.6 |

The resulting reaction product has a fruity aroma with linalool-like topnote.

Figure 1:
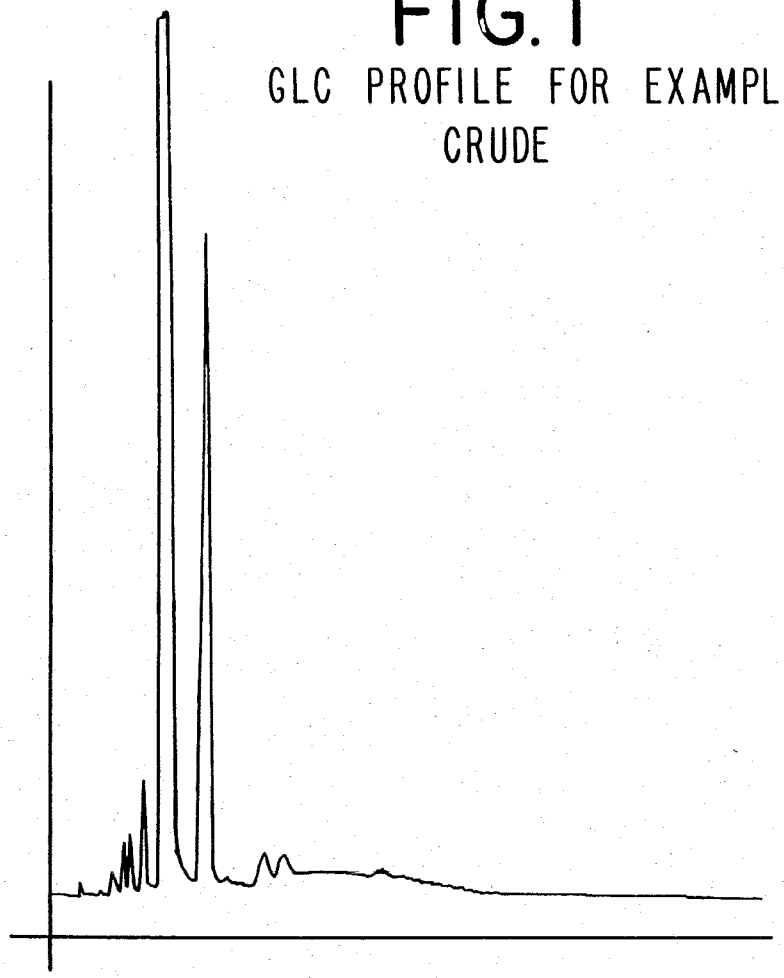
FIG. 1 is the GLC profile for the crude reaction product of Example I (conditions: SE-30, col. programmed at 200° C. isothermal) containing the compound having the structure.

FIG. 1 is the GLC profile for the crude reaction product prior to distillation (conditions: SE-30, column programmed at 200° C., isothermal).

FIG. 2 is the NMR spectrum for the crude reaction product prior to distillation (conditions: $CFCl_3$ solvent; 100 MHz field strength).

FIG. 3 is the infra-red spectrum for the crude reaction product of the foregoing process.

EXAMPLE II

PREPARATION OF THE MONOACETATE-MONOISOBUTYRATE DIESTER OF 1,3-DIHYDROXY-2,2-DIMETHYL PROPANE

Reactions:

EXAMPLE IIA

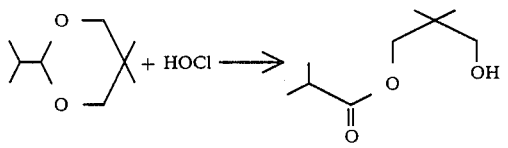

EXAMPLE IIB

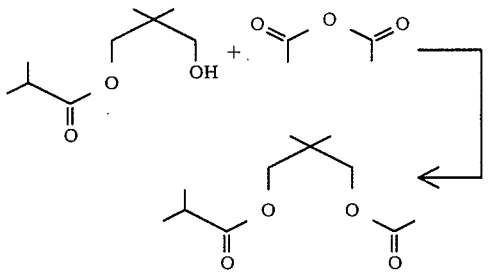

EXAMPLE IIA

Into a 5 liter reaction flask equipped with stirrer, thermometer, reflux condensor, dropping funnel and cooling bath is placed 266 grams of acetic acid and 360 grams of isobutyraldehyde neopentyl acetal having the structure:

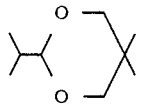

Into the dropping funnel is place 1,865 grams of 10% aqueous sodium hypochlorite. Over a period of three hours while maintaining the reaction mass at 15° C., the aqueous sodium hypochlorite is added to the reaction mass with stirring.

After the addition of the aqueous sodium hypochlorite to the reaction mass, the reaction mass is poured into a 10% aqueous sodium chloride solution and washed as follows:

(i) 1-liter of 5% sodium hydroxide solution;

(ii) three 1-liter portions of water.

The crude reaction product is then used in Example IIB.

EXAMPLE IIB

Into a 2-liter reaction flask equipped with stirrer, thermometer, reflux condensor, heating mantle is place 300 grams of acetic anhydride. The acetic anhydride is heated with stirring to 100° C. Then, into the dropping funnel, is placed the reaction product of Example IIA having the structure:

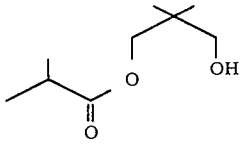

Over a period of 5 hours, the compound having the structure:

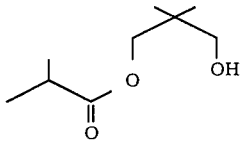

is added from the dropping funnel into the acetic anhydride mixture while maintaining the reaction mass at 100° C.

At the end of the 5 hour period the reaction mass is cooled to 90° C. and 1-liter of water is added. The reaction mass is then poured into 2-liters of a 10% aqueous sodium chloride solution and washed as follows:

(i) 1-liter of 5% aqueous sodium hydroxide;

(ii) four 1-liter portions of water

The reaction mass is then distilled on a 12" stone packed column yielding the following fractions:

| Fraction No. | Vapor Temp. (°C.) | Liquid Temp. (°C.) | Vacuum mm. Hg. Pressure | Reflux Ratio | Weight of Fraction |
|---|---|---|---|---|---|
| 1 | 72/70 | 106/104 | 1.0/1.09 | 9:1 | 14.6 |
| 2 | 74 | 104 | 1.0 | 4:1 | 15.3 |
| 3 | 70 | 103 | 1.0 | 4:1 | 17.8 |
| 4 | 71 | 103 | 1.0 | 100% | 21.8 |
| 5 | 71 | 103 | 1.0 | " | 25.4 |
| 6 | 71 | 103 | 1.0 | " | 25.4 |
| 7 | 71 | 103 | 1.0 | " | 23.6 |
| 8 | 71 | 103 | 1.0 | " | 24.0 |
| 9 | 70 | 104 | 1.0 | " | 23.2 |
| 10 | 70 | 104 | 1.0 | " | 26.0 |
| 11 | 70 | 130 | 1.0 | " | 20.0 |
| 12 | 70 | 140 | 1.0 | " | 23.3 |
| 13 | 66 | 170 | 2.0 | " | 2.0 |

The reaction product has an interesting fruity, peachy, raspberry ionone-like, woody, piney, Virginia tobacco-like aroma with oxphenylon-like and angelica lactone-like nuances from a fragrance standpoint. From a flavor standpoint it has a fruity, rum-like aroma characteristic with sweet, fruity, butterscotch-like, rum-like and sweet flavor characteristics causing it to be useful in tropical fruit, rum and dairy products.

FIG. 4 is the GLC profile of the crude reaction product of Example II(a) containing the product defined according to the structure:

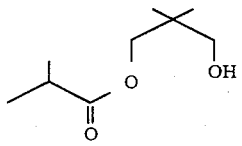

The peak indicated by reference "10" is for the product having the structure:

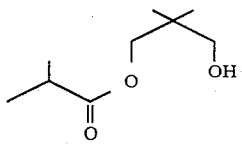

FIG. 5 is the GLC profile for the crude reaction product produced according to Example II(b) containing the compound having the structure:

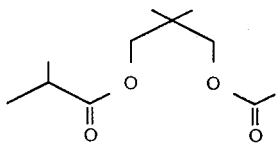

(conditions: SE-30, col. programmed at 200° C. isothermal).

FIG. 6 is the NMR spectrum for the reaction product of Example II(b) containing the compound having the structure:

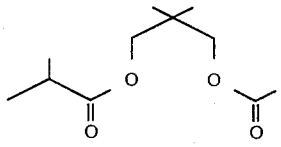

(conditions: $CFCl_3$ solvent; 100 MHz field strength).

FIG. 7 is the infra-red spectrum for the reaction product of Example II(b) containing the compound having the structure:

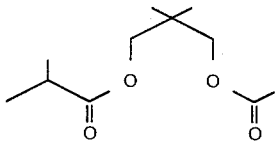

EXAMPLE III

A jasmine formula is produced containing the following ingredients:

| Ingredients | Parts by Weight |
|---|---|
| Isoeugenol | 2.0 |
| Benzyl Propionate | 10.0 |
| Benzyl Acetate | 13.0 |
| Benzyl Alcohol | 14.0 |
| Benzyl Benzoate | 9.0 |
| Linalool | 8.0 |
| Phytol | 30.0 |
| Methyl Oleate | 4.0 |
| Methyl Palmitate | 4.0 |
| Indole - 10% in Diethyl Phthalate | 1.0 |
| The compound defined according to the structure: 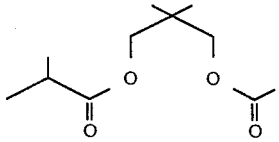 produced according to Example II(b) | 5.0 |

The material produced according to Example II(b) incorporated into the formula above at 5.0% gives rise to the pleasant fruityness aroma undertone of this jasmine formulation.

EXAMPLE IV

The following sweet, floral formula is produced:

| Ingredients | Parts by Weight |
|---|---|
| Hexyl Cinnamic Aldehyde | 12.0 |
| Benzyl Propionate | 8.0 |
| Isoeugenol | 2.0 |
| Indole - 10% in Diethyl Phthalate | 1.0 |
| Linalool | 8.0 |
| Benzyl Acetate | 8.0 |
| Vetivert Oil - Bourbon | 2.0 |
| Gamma Methyl Ionone | 1.0 |
| Phenyl Ethyl Alcohol | 6.0 |
| Patchouli Oil Light | 1.0 |
| Lavandin Abrialis | 4.0 |
| Hydroxy Citronellal | 4.0 |
| Bergamot Oil M.P.F. | 6.0 |
| Benzyl Salicylate | 13.0 |
| Musk Ambrette | 8.0 |
| Coumarin | 6.0 |
| Compound having the structure: 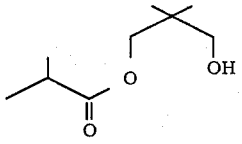 produced according to Example I | 10.0 |

At the 10% level in the foregoing sweet, floral formulation the compound having the structure:

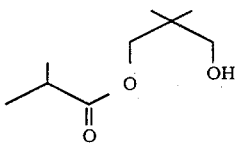

produced according to Example I contributes an intense and pleasant fruity, floralcy to the sweet, floral fragrance.

EXAMPLE V

A stable lotion is prepared with the following formulations:

| Ingredients | Parts by Weight |
|---|---|
| poly(N,N—dimethyl-3,5-dimethylene piperidinium chloride) (Merquat 100, Merck & Co., U.S.A., average molecular weight 50,000–100,000, viscosity in 40% aqueous solution, 10,000 cps. | 1.0 |
| cocoamidopropyl dimethyl glycine (betaine) | 5.7 |
| myristyl dimethylamine oxide | 12.0 |
| stearic monoethanolamide opacifier | 2.0 |
| Perfume as indicated in Table II (below) giving rise to the aroma profiles as indicated in Table II (below) | 0.5 |
| water, color, slats, U.V. absorber | q.s. to 100 |

Two or three bottle capfuls of the above lotion held under the tap releasing the water into the bathtub yields a copiously foamed bubble bath with no visible precipitation flocculation, or "bathtub ring" even using hard water. Bathing in this bath is found to have a cleansing and pleasing emollient effect on the skin as described above.

When, after immersion in this bath, the body is soaped, rinsed and dried, an even better, more long-lasting emollient, moisturizing effect on the skin is observed. The foam or bubbles are substantially unaffected by the soaping step, and no precipitate, flocculate or "bathtub ring", or any bothersome film or coating on the bathtub surface is found.

The aroma produced is as set forth in Table II, below:

TABLE II

| Product | Aroma Profile |
|---|---|
| Perfume composition of Example III | A jasmine aroma with a pleasant fruityness. |
| Perfume composition of Example IV | A sweet, floral fragrance with pleasant fruity undertones. |
| Product produced according to Example I, having the structure: 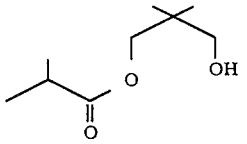 | A fruity aroma with a linalool topnote. |
| Product produced according to Example II(b) having the structure: 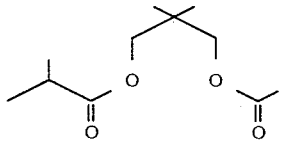 | A fruity aroma with linalool-like topnote. |

EXAMPLE VI

The following shampoo is prepared containing the following ingredients:

| Ingredients | Parts by Weight |
|---|---|
| Tridecyloxy polyethoxy ethanol of ten ethoxy groups | 17.3 |
| Polyoxyethylene (20) sorbitan monolaurate | 7.5 |
| Myristyl dimethylamine oxide (30% active) | 25.0 |
| $C_{10}$–$C_{20}$ fatty acyl monoethanolamide (cocomonoethanolamide) | 2.5 |
| Polyacrylamide of molecular weight of about 1,500,000 | 0.2 |
| Hydrogen peroxide (30% queous solution) | 0.5 |
| Perfume ingredient as indicated in Table II of Example V, supra giving rise to the aroma profiles as indicated in Table II of Example V, supra | 1.0 |
| Deionized water (3 micromhos/cm conductivity) | 46.0 |

A shampoo of the above composition is made in the following matter. First, the tridecyloxy polyethoxy ethanol is added to a clean mixing tank, with the agitator on, and the amine oxide, polyoxyethylene sorbitan monolaurate and cocomonoethanolamine are added sequentially, with continued agitation. The mix is then heated to 68° C., until the cocomonoethanolamide is melted and/or dissolved. The hydrogen peroxide solution is then admixed with the mentioned nonionics and mixing is continued for about half an hour, in which the peroxide destroys any free amines or other harmful impurities that may be present. The mix is then cooled to 38° C.

In a separate mixer the polyacrylamide is gradually added to the formula weight of deionized water, with the mixer on. Addition is effected carefully and slowly (the polyacrylamide is sprinkled in) to avoid the production of "fish eyes" in the mix. After dissolving of the polyacrylamide the solution thereof is added to the first mixing tank with agitation and is blended with the nonionics, such mixings being at room temperature. Subsequently the perfume as indicated in Table II of Example V, supra giving rise to the aroma profile as set forth in Table II of Example V, supra is admixed with the balance of the composition and mixing is continued for another half hour.

The product made is an excellent shampoo of satisfactory viscosity and aroma, foaming power, foam stability, low conductivity and good shampooing effects. The viscosity is about 1,000 centipoises at 20° C. and the conductivity, using the Hach Conductivity Meter, is 750 micromhos/cm. The foaming power is 250 ml and the foam stability is 22 seconds, by the test method previously described. In comparison, a commercial shampoo based on triethanolamine lauryl sulphate detergent has a conductivity of about 22,000 micromhos/cm, a viscosity of about 1,500 centipoises, a foaming power of about 380 ml and a foam stability of 60 seconds.

In panel evaluations of the experimental shampoo compared to a different commercial product, in actual shampooing, the experimental formula was adjudged significantly better in being less drying, producing a softer feel for the wet hair, leaving the wet hair easier to comb, being less prone to accumulate static charges (less flyaway) and having a foam of better appearance and feel. Additionally, the experimental product was judged better in almost all hair effect properties, with the control only being about equal to it in curl retention. In properties other than those mentioned the experimental product was better in rinsability, the control was better in foam build-up rate and the foams were about equal in volume and stability.

In the shampooing described herein and in subsequent Examples the human hair is washed on the head by wetting the hair with warm tap water at about 42° C., applying 15 grams of shampoo to the hair, lathering it into the hair for a minute, rinsing with warm tap water for 30 seconds, re-lathering with 7 grams of shampoo for a minute and rinsing off for 30 seconds, after which the hair is towel dried and dried further with an automatic hair dryer.

EXAMPLE VII

Fabric Freshener Composition

A fabric freshener composition is prepared as follows:

| Ingredients | Parts by Weight |
|---|---|
| Sodium bicarbonate | 3 |
| "Kyro" EOB (Trade Mark)* | 1 |
| Perfume ingredient as set forth in Table II of Example V, supra giving rise to an aroma as set forth in Table II of Example V, supra | 1 |
| Water | 0.05 |

*A commerical nonionic surfactant comprising an average of eleven carbon atoms, ethoxylated to an average of 9 ethylenenoxy groups per molecule.

The composition of this Example is prepared by simply mixing the ingredients.

The above described composition is applied to a lightly soiled and wrinkled fabric as droplets (ca. 5.0 mm avg. size) using a trigger action sprayer having a nozzle which is adjustable to provide composition droplets in the desired range. The composition is applied at a rate of about 1 gram of composition to about 10 grams of fabric.

The fabric is then placed in an automatic dryer and dried, with tumbling action, at a temperature of 60°-80° C. for a period of 15 minutes. The fabric is rendered free of wrinkles and static, and has a fresh appearance and pleasant odor profile as set forth in Table II of Example V, supra. Surprisingly, the sodium bicarbonate is not visible on the refreshed fabric.

EXAMPLE VIII

Perfumed Liquid Detergent

Concentrated liquid detergents (lysine salts of n-dodecyl benzene sulfonic acid as more specifically described in U.S. Pat. No. 3,948,818, issued on Apr. 6, 1976) with aromas as indicated in Table II of Example V, supra are prepared containing 0.10%, 0.15%, 0.20%, 0.25%, 0.30%, 0.40%, 0.50% and 0.80% of the perfume ingredient as set forth in Table II of Example V, supra. The detergents are prepared by adding a homogeneously mixing the appropriate quantity of perfume ingredient as set forth in Table II of Example V, supra. The detergents all possess aromas as set forth in Table II of Example V, supra with the intensity of each increasing with greater concentrations of the perfume ingredient as indicated in Table II of Example V, supra.

EXAMPLE IX

Preparation of a Cologne and Handkerchief Perfume

The perfume ingredient as set forth in Table II of Example V, supra is incorporated into colognes at concentrations of 2.0%, 2.5%, 3.0%, 3.5%, 4.0%, 5.0% and 6.0% in 75%, 80%, 85%, 90% and 95% aqueous ethanol solutions. Distinct and definite aromas as set forth in Table II of Example V, supra are imparted to the colognes. The perfume ingredients as indicated in Table II of Example V, supra are also added to handkerchief perfumes at concentrations of 15%, 20%, 25%, 30% and 35% (in 75%, 80%, 85%, 90% and 95% aqueous ethanol) and aroma profiles as set forth in Table II of Example V, supra are imparted to the handkerchief perfume.

EXAMPLE X

Raspberry Flavors

The following basic raspberry formulation is prepared:

| Ingredients | Parts by Weight |
|---|---|
| Vanillin | 2 |
| Maltol | 4 |
| Parahydroxy benzyl acetone | 5 |
| Dimethyl sulfide | 1 |
| Alpha-ionone (10% in propylene glycol) | 2 |
| Ethyl butyrate | 6 |
| Ethyl acetate | 16 |
| Isobutyl acetate | 14 |
| Acetic acid | 10 |
| Acetaldehyde | 10 |
| Propylene glycol | 930 |
| | 1000 |

The above formulation is split into two parts. To the first part, at the rate of 0.3% is added the compound having the structure:

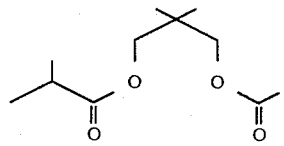

produced according to Example II(b). No additive is added to the second part. The two formulations are compared in water at the rate of 50 ppm. The flavor containing the compound having the structure:

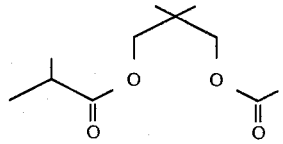

has a more ripe raspberry taste and woody, raspberry kernel characteristic. Therefore the raspberry formulation containing the compound having the structure:

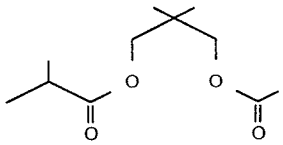

has a more natural-like and more characteristic raspberry flavor and is therefor preferred.

EXAMPLE XI

Fruited Tapioca Cream

The contents of Ann Page Tapioca pudding mix (ingredients: sugar, corn starch, tapioca, sodium chloride, tapioca flavor and artificial color; Net weight 138 grams) is emptied into a sauce pan. Three cups of milk are added together with one beaten egg yolk previously blended therewith. The resulting mix is cooked over medium heat stirring constantly while slowly adding at the rate of 0.2%, one of the following flavor materials:

(a) The compound defined according to the structure:

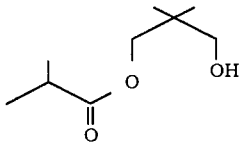

(b) The compound defined according to the structure:

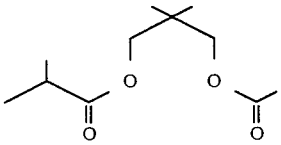

(c) The raspberry flavor of Example X.

The resulting mixtures after heating are then cooled to room temperature in a sauce pan. One egg white is slowly added to the resulting mixture, together with three tablespoons of sugar. The resulting mixture is then blended and chilled yielding pleasantly tasting strawberry or raspberry tapioca cream deserts thusly:

(i) The compound of Example I—strawberry flavored desert;

(ii) The compound of Example II—a raspberry flavored desert;

(iii) The flavor formulation of Example X—a raspberry flavored desert.

EXAMPLE XII

Flavored Instant Pudding

A pudding mix (Royal Instant, Net weight 3.5 ozs. produced by Standard Brands Inc., New York, N.Y. 10022) is intimately admixed with 2 cups of cold fresh whole milk. To this mixture, at the rate of 0.3%, is added the flavor formulation of Example X containing the compound having the structure:

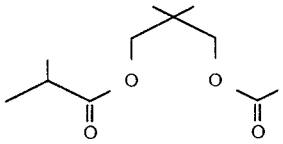

The resulting mixture is blended in a Waring blender for a period of three minutes. The resulting mixture is then cooled at 15° C. for a period of five minutes. The resulting pudding has an excellent natural raspberry flavor.

EXAMPLE XIII

A. Powder Flavor Formulation

20 Grams of the flavor composition of Example X is emulsified in a solution containing 300 grams of gum acacia and 700 grams water. The emulsion is spray dried with a Bowen Lab Model Drier utilizing 260 c.f.m. of air with an inlet temperature of 500° F., an outlet temperature of 200° F. and a wheel speed of 50,000 rpm.

B. Sustained Release Flavor

The following mixture is prepared:

| Ingredients | Parts by Weight |
|---|---|
| Liquid raspberry flavor of Example X | 20.00 |
| Propylene glycol | 9.00 |
| Cab-O-Sil ® M-5 (Brand of Silica produced by the Cabot Corp. of 125 High Street Boston, Massachusetts 02110; Physical Properties: Surface area: 200 $m^2$/gm Nominal particle size: 0.012 microns Density: 2.3 lbs./cu.ft. | 5.00 |

The Cab-O-Sil is dispersed in the liquid raspberry flavor composition of Example X with vigorous stirring, thereby resulting in a viscous liquid. 71 Parts by weight of the powder flavor composition of Part A, supra, is then blended into the said viscous liquid, with stirring, at 25° C. for a period of 30 minutes resulting in a dry, free flowing sustained release raspberry flavor powder.

EXAMPLE XIV

10 Parts by weight of 50 Bloom pigskin gelatin added to 90 parts by weight of water at a temperature of 150° F. The mixture is agitated until the gelatin is completely dissolved and the solution is cooled to 120° F. 20 Parts by weight of the liquid raspberry flavor composition of Example X containing the compound having the structure:

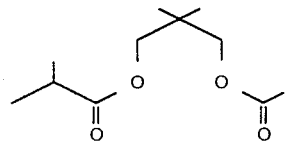

is added to the solution which is then homogenized to form an emulsion having a particle size typically in the range of 5–40 microns. This material is kept at 120° F. under which conditions the gelatin will not jell.

Coacervation is induced by adding, slowly and uniformly 40 parts by weight of a 20% aqueous solution of sodium sulphate. During coacervation the gelatin molecules are deposited uniformly about each oil droplet as a nucleus.

Gelation is effected by pouring the heated coacervate mixture with 1,000 parts by weight of 7% aqueous solution of sodium sulphate at 65° F. The resulting jelled coacervation may be filtered and washed with water at temperatures below the melting point of gelatin, to remove the salt.

Hardening of the filtered cake, in this example, is effected by washing with 200 parts by weight of 37% solution of formaldehyde in water. The cake is then carefully washed to remove residual formaldehyde.

EXAMPLE XV

100 Parts by weight of chicle are mixed with 4 parts by weight of the flavor prepared in accordance with Example XIII(b). 300 Parts of sucrose and 100 parts of corn syrup are added. Mixing is effected in a ribbon blender with jacketed side walls of the type manufactured by the Baker Perkins Co.

The resulting chewing gum blend is then manufactured into strips 1 inch in width and 0.1 inches in thickness. The strips are cut into lengths of 3 inches each. On chewing, the chewing gum has a pleasant, long lasting raspberry flavor.

EXAMPLE XVI

Chewing Gum

100 Parts by weight of chicle are mixed with 18 parts by weight of the flavor prepared in accordance with Example XIV. 300 Parts of sucrose and 100 parts of corn syrup are then added. Mixing is effected in a ribbon blender with jacketed side walls of the type manufactured by the Baker Perkins Co.

The resulting chewing gum blend is then manufactured into strips 1 inch in width and 0.1 inches in thickness. The strips are cut into lengths of 3 inches each. On chewing, the chewing gum has a pleasant, long lasting raspberry flavor.

EXAMPLE XVII

Toothpaste Formulation

The following separate groups of ingredients are prepared:

| Parts by Weight | Ingredients |
|---|---|
| Group "A" | |
| 30.200 | Glycerine |
| 15.325 | Distilled Water |
| .100 | Sodium Benzoate |
| .125 | Saccharin Sodium |
| .400 | Stannous Fluoride |
| Group "B" | |
| 12.500 | Calcium Carbonate |
| 37.200 | Dicalsium Phosphate (Dihydrate) |
| Group "C" | |
| 2.000 | Sodium N—Lauroyl Sarcosinate (foaming agent) |
| Group "D" | |
| 1.200 | Flavor Material of Example XII(b) |
| 100.00 Total | |

PROCEDURE

1. The ingredients in Group "A" are stirred and heated in a steam jacketed kettle to 160° F.
2. Stirring is continued for an additional three to five minutes to form a homogeneous gel.
3. The powders of Group "B" are added to the gel, while mixing, until a homogeneous paste is formed.
4. With stirring, the favor of "D" is added and lastly the sodium n-lauroyl sarcosinate.
5. The resultant slurry is then blended for one hour. The completed paste is then transferred to a three roller mill and then homogenized, and finally tubed.

The resulting toothpaste when used in a normal toothbrushing procedure yields a pleasant raspberry flavor, of constant strong intensity throughout said procedure (1–1.5 minutes).

EXAMPLE XVIII

Chewable Vitamin Tablets

The flavor material of Example XIV is added to a chewable vitamin tablet formulation at the rate of 10 gm/kg which chewable vitamin tablet formulation is prepared as follows:

In a Hobart Mixer the following materials are blended to homogeneity:

| | Gms/1000 Tablets |
|---|---|
| Vitamin C (ascorbi acid) as ascorbic acid-sodium ascorbate mixture 1:1 | 70.00 |
| Vitamin $B_1$ (thiamine mononitrate 33⅓% (Hoffman La Roche) | 4.0 |
| Vitamin $B_2$ (roboflavin) as Rocoat ® roboflavin 33⅓% | 5.0 |
| Vitamin $B_6$ (pyridoxine hydrochloride) as Rocoat ® pyridoxine hydrochloride 33⅓% | 4.0 |
| Niacinamide as Rocoat ® niacinamide 33⅓% | 33.0 |
| Calcium pantothenate | 11.5 |
| Vitamin $B_{12}$ (cyanocobalamin) as Merck 0.1% in gelatin | 3.5 |
| Vitamin E (dl-alpha tocopheryl acetate) as dry Vitamin E acetate 33⅓% | 6.6 |
| d-Biotin | 0.044 |
| Flavor of Example XIV | (as indicated above) |
| Certified lake color | 5.0 |
| Sweetner - sodium saccharin | 1.0 |
| Magnesium stearate lubricant | 10.0 |
| Mannitol q.s. to make | 500.0 |

Preliminary tablets are prepared by slugging with flat-faced punches and grinding the slugs to 14 mesh. 13.5 G dry Vitamin A Acetate and 0.6 g Vitamin D are then added as beadlets. The entire blend is then compressed using concave punches at 0.5 g each.

Chewing of the resultant tablets yields a pleasant long lasting, consistently strong raspberry flavor for a period of 12 minutes.

EXAMPLE XIX

Chewing Tobacco

Onto 100 pounds of tobacco for chewing (85% Wisconsin leaf and 15% Pennsylvania leaf) the following casing is sprayed at a rate of 30%:

| Ingredients | Parts by Weight |
|---|---|
| Corn Syrup | 60.0 |
| Licorice | 10.0 |
| Glycerine | 20.0 |
| Fig Juice | 4.6 |

-continued

| Ingredients | Parts by Weight |
|---|---|
| Prune Juice | 5.0 |
| Flavor Material of Example I having the structure: | 0.4 |

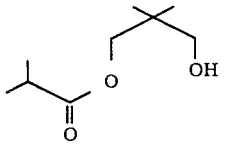

The resultant product is redried to a moisture content of 20%. On chewing, this tobacco has an excellent substantially consistent, long-lasting cherry nuance in conjunction with the tobacco note.

EXAMPLE XX

Tobacco Formulation

A tobacco mixture is produced by admixing the following ingredients:

| Ingredient | Parts by Weight |
|---|---|
| Bright | 40.1 |
| Burley | 24.9 |
| Maryland | 1.1 |
| Turkish | 11.6 |
| Stem (flue-cured) | 14.2 |
| Glycerine | 2.8 |
| Water | 5.3 |

Cigarettes are prepared from this tobacco. The following flavor formulation is prepared:

| Ingredient | Parts by Weight |
|---|---|
| Ethyl butyrate | 0.05 |
| Ethyl valerate | 0.05 |
| Maltol | 2.00 |
| Cocoa extract | 26.00 |
| Coffee extract | 10.00 |
| Ethyl alcohol | 20.00 |
| Water | 41.90 |

The above-stated tobacco flavor formulation is applied at the rate of 0.1% to all of the cigarettes produced using the above tobacco formulation. One third of the cigarettes are then treated with 500 to 1,500 ppm of the compound having the structure:

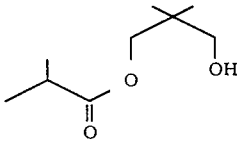

The second third of the cigarettes are treated with 500 to 1,500 ppm of the compound having the structure:

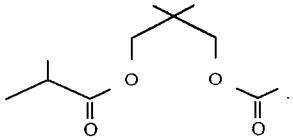

The last third of the cigarettes not containing any oxyneopentyl alkanoate derivatives of my invention are compared with the experimental cigarettes which contain the oxyneopentyl alkanoate derivatives of my invention and they are evaluated by paired comparison and the results are as follows.

The experimental cigarettes containing the compound having the structure:

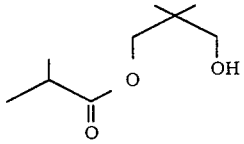

have an excellent fruity and cherry tobacco flavor with cooling nuances and much more body prior to and on smoking in the main stream and the side stream.

The experimental cigarettes containing the compound having the structure:

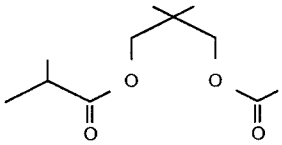

are much more natural-like and Virginia tobacco-like containing woody, ionone and fruity nuances and are also "rum-like" causing the tobacco to be aesthetically pleasing and having novel nuances prior to and on smoking in the main stream and the side stream (in both taste and aroma).

All cigarettes are evaluated for smoke flavor with a 20 mm cellulose acetate filter.

Accordingly, it is concluded that the oxyneopentyl alkanoate derivatives of my invention produced according to the process of Examples I, II enhance the tobacco-like taste and aromas of blended cigarettes imparting to them sweet, fruity and woody tobacco-like nuances.

EXAMPLE XXI

Preparation of a Detergent Composition

A total of 100 grams of detergent powder (a low phosphate content detergent composition which contains 12% by weight phosphate builder, 8% hardness mineral ion insensitive detergent, 0.9% by weight maleic anhydride-vinyl compound co-polymer and 2% alkylene oxide condensation product prepared according to Example IV at column XI, of U.S. Pat. No. 4,000,080 issued on Dec. 28, 1976) the specification for which is incorporated by reference herein, is intimately admixed with 0.15 grams of one of the perfume materials of Table II of Example V, supra, until a substantially homogeneous composition is obtained. This composition has an aromas as set forth in Table II of Example V, supra which are pleasant and long lasting.

EXAMPLE XXII

Perfumed Liquid Detergents

Concentrated liquid detergents with aromas as set forth in Table II of Example V, supra, are prepared containing 0.10%, 0.15%, and 0.20% of the perfume ingredients set forth in Table II of Example V, supra. They are prepared by adding and homogeneously mixing the appropriate quantity of perfume ingredient set forth in Table II of Example V, supra, in a liquid detergent which is a homogeneous single-phase heavy duty liquid detergent composition containing:

a. 12.5% by weight based on the free acid form of an anionic detersive surfactant;
b. 0.5% magnesium sulfate;
c. 12% by weight of an ethoxylated nonionic detersive surfactant;
d. 3% by weight of a water-soluble bis(styrylsulfonate)-biphenyl brightener; and
e. the balance of the composition being water, prepared according to U.S. Pat. No. 3,998,750 issued on Dec. 21, 1976 (the specification for which is incorporated by reference herein).

EXAMPLE XXIII

Scented polyethylene pellets having pronounced aromas as set forth in Table II of Example VII are prepared as follows.

75 Pounds of polyethylene having a melting point of about 220° F. is heated to about 230° F. in a container of the kind illustrated in FIGS. 8 and 9.

75 Pounds of the aroma imparting material of Table II of Example V is then quickly added to the liquified polyethylene, the lid 228 is put in place and the agitating means 273 are actuated. The temperature is maintained at about 225° F. and the mixing is continued for about 5–15 minutes. The valve "V" is then opened to allow flow of the molten polyethylene enriched with the aroma imparting-containing materials to exist through the orifices 234. The liquid falling through the orifices 234 solidifies almost instantaneously upon impact with the moving cooled conveyor 238. Polyethylene beads or pellets 244 having pronounced aromas as set forth in Table II of Example V are thus formed. Analysis demonstrates that these pellets contain about 25% of the aroma imparting formulations so that almost no losses in the scenting substance occur. These pellets may be called "master pellets".

50 Pounds of the scent imparting "master pellets" are then added to 1000 pounds of unscented polyethylene powder and the mass is heated to the liquid state. The liquid is molded into thin sheets of film. The sheets of films have pronounced aromas as set forth in Table II of Example V.

EXAMPLE XXIV

100 Pounds of polypropylene are heated to about 300° F. 30 Pounds of one of the aromatizing materials as set forth in Table II of Example V are added to the liquified polypropylene. The procedure is carried out in the apparatus as shown in FIGS. 8 and 9. After mixing for about 8 minutes, the valve "V" is opened to allow the exit of polypropylene scented material mixture whereby solid pellets having a pronounced perfume smell (as indicated in Table II of Example V, supra) were formed on the conveyor. The pellete thus obtained are then admixed with about 20 times their weight of unscented polypropylene and the mixture is heated and molded into flat discs. The flat discs have strong and pleasant aromas as set forth in Table II of Example V, supra.

EXAMPLE XXV

Utilizing the procedure of Example I at column 15 of U.S. Pat. No. 3,632,396 (the disclosure of which is incorporated herein by reference), nonwoven cloth substrates useful as drier added fabric softening articles of manufacture are prepared wherein the substrate, the substrate coating, the outer coating and the perfuming material are as follows:

1. a water "dissolvable" paper ("Dissolvo Paper")
2. Adogen 448 (m.p. about 140° F.) as the substrate coating and
3. an outer coating having the following formulation (m.p. about 150° F.):
   57% $C_{20-22}$ HAPS
   22% isopropyl alcohol
   20% antistatic agent
   1% of one of the substances as set forth in Table II of Example V, supra.

Fabric softening compositions prepared according to Example I at column 15 of U.S. Pat. No. 3,632,396 having aroma chracteristics as set forth in Table II of Example V, supra, consist of a substrate coating having a weight of about 3 grams per 100 square inches of substrate; a first coating located directly on the substrate coating consisting of about 1.85 grams per 100 square inches of substrate; and an outer coating coated on the first coating consisting of about 1.4 grams per 100 square inches of substrate. One of the substances of Table II of Example V, supra is admixed in each case with the outer coating mixture, thereby providing a total aromatized outer coating weight ratio to substrate of about 0.5:1 by weight of the substrate. The aroma characteristics are imparted in a pleasant manner to the head space in a drier on operation thereof in each case using said drier-added fabric softener nonwoven fabrics and these aroma characteristics are described in Table II of Example V, supra.

What is claimed is:

1. A process for augmenting or enhancing the aroma of a perfumed article selected from the group consisting of solid or liquid anionic, cationic, nonionic or zwitterionic detergents and fabric softener compositions and dryer added fabric softener articles comprising the step of adding to said perfumed article an aroma augmenting or enhancing quantity of at least one compound defined according to the structure:

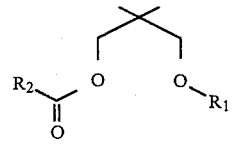

wherein $R_1$ is hydrogen or acetyl and $R_2$ is isopropyl.

2. The process of claim 1 wherein the perfumed article is a solid or liquid anionic, cationic, nonionic or zwitterionic detergent.

3. The process of claim 1 wherein the perfumed article is a fabric softener composition, or dryer added fabric softener article.

* * * * *